US011913291B2

(12) United States Patent
McCormick et al.

(10) Patent No.: US 11,913,291 B2
(45) **Date of Patent: *Feb. 27, 2024**

(54) DEVICE FOR CENTERING A SENSOR ASSEMBLY IN A BORE

(71) Applicant: PETROMAC IP LIMITED, Auckland (NZ)

(72) Inventors: Stephen Peter McCormick, Auckland (NZ); Benno Frank Smit, Auckland (NZ)

(73) Assignee: PETROMAC IP LIMITED, Auckland (NZ)

( * ) Notice: Subject to any disclaimer, the term of this patent is extended or adjusted under 35 U.S.C. 154(b) by 179 days.

This patent is subject to a terminal disclaimer.

(21) Appl. No.: 17/437,649

(22) PCT Filed: Aug. 5, 2021

(86) PCT No.: PCT/NZ2021/050123

§ 371 (c)(1),
(2) Date: Sep. 9, 2021

(87) PCT Pub. No.: WO2022/031176

PCT Pub. Date: Feb. 10, 2022

(65) Prior Publication Data

US 2022/0298870 A1 Sep. 22, 2022

(30) Foreign Application Priority Data

Aug. 6, 2020 (NZ) ..... 766888

(51) Int. Cl.
*E21B 17/10* (2006.01)
*E21B 23/14* (2006.01)

(52) U.S. Cl.
CPC ..... *E21B 17/1021* (2013.01); *E21B 17/1057* (2013.01); *E21B 23/14* (2013.01)

(58) Field of Classification Search
CPC ..... E21B 17/1021; E21B 17/1057
See application file for complete search history.

(56) References Cited

U.S. PATENT DOCUMENTS 3,423,671 A * 1/1969 Vezin ..... G01V 3/20 33/312
4,557,327 A 12/1985 Kinley et al.
(Continued)

FOREIGN PATENT DOCUMENTS

WO 2019246105 A1 12/2019

OTHER PUBLICATIONS

Australian Patent Office, Appln. No. PCT/NZ2021/050123, Written Opinion of the International Searching Authority, dated Sep. 17, 2021; 7 pages.

(Continued)

*Primary Examiner* — Theodore N Yao
(74) *Attorney, Agent, or Firm* — DANN, DORFMAN, HERRELL and SKILLMAN, P.C.

(57) ABSTRACT

A centraliser comprises a mandrel, a first support member, a second support member, and a plurality of arm assemblies connected between the first and second support members. Each arm assembly comprises a first arm pivotally connected to the first support member at a first pivot axis and a second arm pivotally connected to the second support member at a second pivot axis, and the first and second arms pivotally connected together at a third pivot axis. The mandrel comprises a plurality of facets spaced apart around an outer surface of the mandrel to rotationally key the first and/or second support member to the mandrel, and each arm assembly is arranged so that the third pivot axis is located on a first side of a plane coincident with a central axis of the device and the first and second pivot axes are located on an opposite second side of the plane.

17 Claims, 19 Drawing Sheets

(56) References Cited

U.S. PATENT DOCUMENTS

| | | | | |
|---|---|---|---|---|
| 4,615,386 | A | 10/1986 | Briscoe | |
| 4,619,322 | A | 10/1986 | Armell et al. | |
| 5,358,040 | A * | 10/1994 | Kinley | E21B 17/1021 175/325.3 |
| 5,574,263 | A | 11/1996 | Roesner | |
| 5,971,404 | A | 10/1999 | Stoves | |
| 7,505,063 | B1 | 3/2009 | Bastedo et al. | |
| 8,919,209 | B2 | 12/2014 | Furlong | |
| 9,863,198 | B2 | 1/2018 | McCormick | |
| 9,963,954 | B2 | 5/2018 | Al-Mulhem | |
| 10,947,791 | B1 * | 3/2021 | McCormick | E21B 23/14 |
| 10,988,991 | B1 | 4/2021 | McCormick | |
| 11,713,627 | B1 * | 8/2023 | McCormick | E21B 17/1021 166/241.6 |
| 2003/0145985 | A1 | 8/2003 | Stuart-Bruges et al. | |
| 2006/0067162 | A1 | 3/2006 | Blankinship et al. | |
| 2012/0048542 | A1 | 3/2012 | Jacob | |
| 2014/0238659 | A1 | 8/2014 | Wheater et al. | |
| 2016/0298396 | A1 | 10/2016 | Church | |
| 2019/0383108 | A1 * | 12/2019 | Massey | E21B 17/1057 |
| 2020/0362645 | A1 | 11/2020 | Donzier et al. | |

OTHER PUBLICATIONS

Australian Patent Office, Appln. No. PCT/NZ2021/050123, International Search Report, dated Sep. 17, 2021, 7 pages.

* cited by examiner

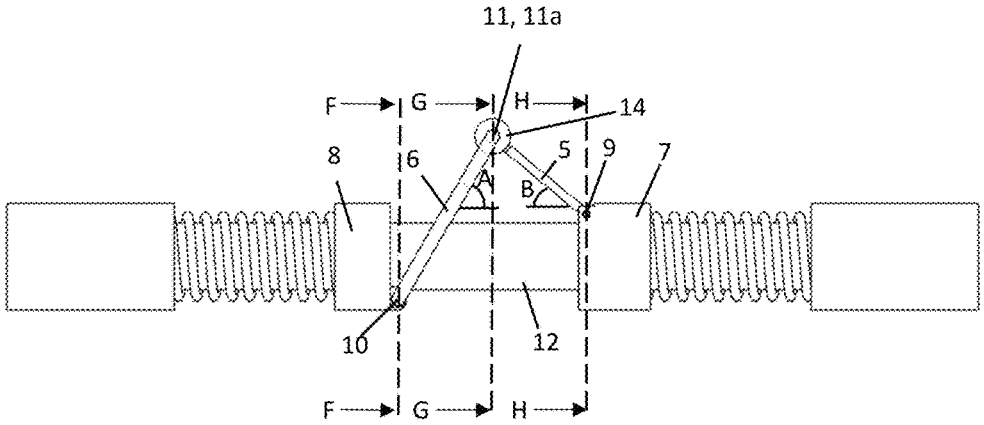
FIGURE 3A
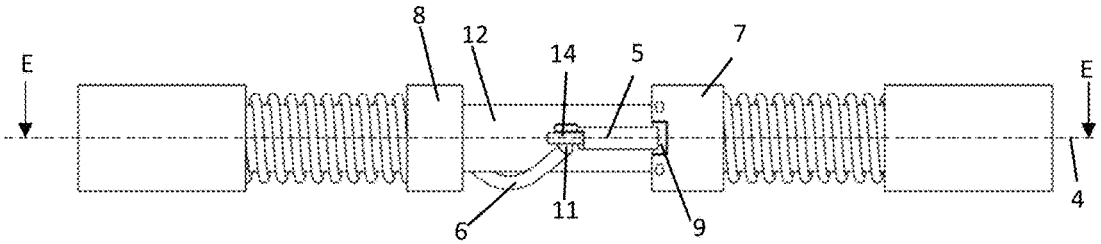
FIGURE 3B
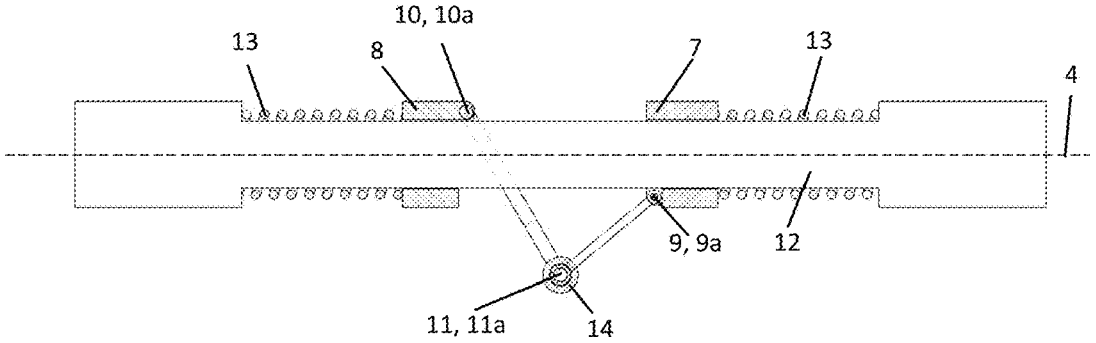
FIGURE 3C
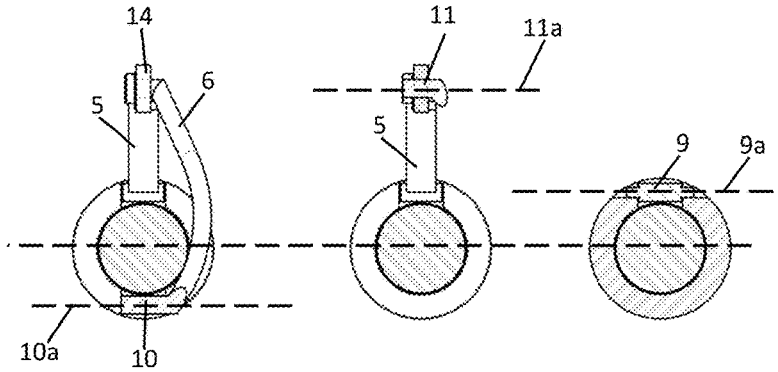
SECTION F - F
FIG. 3D
SECTION G - G
FIG. 3E
SECTION H - H
FIG. 3F

DEVICE FOR CENTERING A SENSOR ASSEMBLY IN A BORE

This application is a U.S. National Stage of International Application No. PCT/NZ2021/050123, filed on Aug. 5, 2021, which claims the benefit of New Zealand Patent Application No. 766888, filed Aug. 6, 2020, the entireties of which are incorporated herein by reference.

TECHNICAL FIELD

This invention relates to devices for use in centering sensor equipment down a bore such as a pipe, a wellbore or a cased wellbore, and in particular to devices for use in centering sensor equipment in wireline logging applications.

BACKGROUND

Hydrocarbon exploration and development activities rely on information derived from sensors which capture data relating to the geological properties of an area under exploration. One approach used to acquire this data is through wireline logging. Wireline logging is performed in a wellbore immediately after a new section of hole has been drilled, referred to as open-hole logging. These wellbores are drilled to a target depth covering a zone of interest, typically between 1000-5000 meters deep. A sensor package, also known as a "logging tool" or "tool-string" is then lowered into the wellbore and descends under gravity to the target depth of the wellbore well. The logging tool is lowered on a wireline—being a collection of electrical communication wires which are sheathed in a steel cable connected to the logging tool. The steel cable carries the loads from the tool-string, the cable itself, friction forces acting on the downhole equipment and any overpulls created by sticking or jamming. Once the logging tool reaches the target depth it is then drawn back up through the wellbore at a controlled rate of ascent, with the sensors in the logging tool operating to generate and capture geological data.

Wireline logging is also performed in wellbores that are lined with steel pipe or casing, referred to as cased-hole logging. After a section of wellbore is drilled, casing is lowered into the wellbore and cemented in place. The cement is placed in the annulus between the casing and the wellbore wall to ensure isolation between layers of permeable rock layers intersected by the wellbore at various depths. The cement also prevents the flow of hydrocarbons in the annulus between the casing and the wellbore which is important for well integrity and safety. Oil wells are typically drilled in sequential sections. The wellbore is "spudded" with a large diameter drilling bit to drill the first section. The first section of casing is called the conductor pipe. The conductor pipe is cemented into the new wellbore and secured to a surface well head. A smaller drill bit passes through the conductor pipe and drills the surface hole to a deeper level. A surface casing string is then run in hole to the bottom of the hole. This surface casing, commonly 20" (nominal OD) is then cemented in place by filling the annulus formed between the surface casing and the new hole and conductor casing. Drilling continues for the next interval with a smaller bit size. Similarly, intermediate casing (e.g. 13⅜") is cemented into this hole section. Drilling continues for the next interval with a smaller bit size. Production casing (e.g. 9⅝" OD) is run to TD (total depth) and cemented in place. A final casing string (e.g. 7" OD) is cemented in place from a liner hanger from the previous casing string. Therefore, the tool-string must transverse down a cased-hole and may need to pass into a smaller diameter bore.

There is a wide range of logging tools which are designed to measure various physical properties of the rocks and fluids contained within the rocks. The logging tools include transducers and sensors to measure properties such as electrical resistance, gamma-ray density, speed of sound and so forth. The individual logging tools are combinable and are typically connected together to form a logging tool-string. Some sensors are designed to make close contact with the borehole wall during data acquisition whilst others are ideally centered in the wellbore for optimal results. These requirements need to be accommodated with any device that is attached to the tool-string. A wireline logging tool-string is typically in the order of 20 ft to 100 ft long and 2" to 5" in diameter.

In cased hole, logging tools are used to assess the strength of the cement bond between the casing and the wellbore wall and the condition of the casing. There are several types of sensors and they typically need to be centered in the casing. One such logging tool utilises high frequency ultrasonic acoustic transducers and sensors to record circumferential measurements around the casing. The ultrasonic transmitter and sensor is mounted on a rotating head connected to the bottom of the tool. This rotating head spins and enables the sensor to record azimuthal ultrasonic reflections from the casing wall, cement sheath, and wellbore wall as the tool is slowly winched out of the wellbore. Other tools have transmitters and sensors that record the decrease in amplitude, or attenuation, of an acoustic signal as it travels along the casing wall. It is important that these transducers and sensors are well centered in the casing to ensure that the data recorded is valid. Other logging tools that measure fluid and gas production in flowing wellbores may also require sensor centralisation.

Logging tools are also run in producing wells to determine flow characteristics of produced fluids. Many of these sensors also require centralisation for the data to be valid.

In open hole (uncased wellbores), logging tools are used to scan the wellbore wall to determine the formation structural dip, the size and orientation of fractures, the size and distribution of pore spaces in the rock and information about depositional environment. One such tool has multiple sensors on pads that contact the circumference of the wellbore to measure micro-resistivity. Other tools generate acoustic signals which travel along the wellbore wall and are recorded by multiple receivers spaced along the tool and around the azimuth of the tool. As with the cased hole logging tools, the measurement from these sensors is optimised with good centralisation in the wellbore.

The drilling of wells and the wireline logging operation is an expensive undertaking. This is primarily due to the capital costs of the drilling equipment and the specialised nature of the wireline logging systems. It is important for these activities to be undertaken and completed as promptly as possible to minimise these costs. Delays in deploying a wireline logging tool are to be avoided wherever possible.

One cause of such delays is the difficulties in lowering wireline logging tools down to the target depth of the wellbore. The logging tool is lowered by a cable down the wellbore under the force of gravity alone. The cable, being flexible, can not push the tool down the wellbore. Hence the operator at the top of the well has very little control of the descent of the logging tool.

The chances of a wireline logging tools failing to descend is significantly increased with deviated wells. Deviated wells do not run vertically downwards and instead extend downward and laterally at an angle from vertical. Multiple deviated wells are usually drilled from a single surface location to allow a large area to be explored and produced. As wireline logging tools are run down a wellbore with a cable under the action of gravity, the tool-string will drag along the low side or bottom of the wellbore wall as it travels downwards to the target depth. The friction or drag of the tool-string against the wellbore wall can prevent to tool descending to the desired depth. The long length of a tool string can further exacerbate problems with navigating the tool string down wellbore.

With reference to FIG. 1, in deviated wells the weight of the tool-string exerts a lateral force (PW) perpendicular to the wellbore wall. This lateral force results in a drag force which acts to prevent the tool-string descending the wellbore. The axial component of tool-string weight (AW) acts to pull the tool-string down the wellbore and this force is opposed by the drag force which acts in the opposing direction. As the well deviation increases the axial component of tool weight (AW) reduces and the lateral force (PW) increases. When the drag resulting from the lateral force (PW) equals the axial component (AW) of tool-string weight the tool will not descend in the wellbore.

As hole deviation increases, the sliding friction or drag force can prevent the logging tool descending. The practical limit is 60° from the vertical, and in these high angle wells any device that can reduce friction is very valuable. The drag force is the product of the lateral component of tool weight acting perpendicular to the wellbore wall and the coefficient of friction. It is desirable to reduce the coefficient of friction in order to reduce the drag force. The coefficient of friction may be reduced by utilising low friction materials, such as Teflon. The drag force may also be reduced by using wheels.

A common apparatus to centralise logging tools is a bow-spring centraliser. Bow-spring centralisers incorporate a number of curved leaf springs. The leaf springs are attached at their extremities to an attachment structure that is fixed to the logging tool. The midpoint of the curved leaf spring (or bow) is arranged to project radially outward from the attachment structure and tool string. When the bow-spring centraliser is not constrained by the wellbore, the outer diameter of the bow-spring centraliser is greater than the diameter of the wellbore or casing in which it is to be deployed. Once deployed in the wellbore, the bow-springs are flattened and the flattened bow springs provide a centering force on the tool string. In deviated wells this centering force must be greater than the lateral weight component of the tool string acting perpendicular to the wellbore or casing wall. Consequently, more centering force is required at greater well deviations. If the centering force is too small the centraliser will collapse and the tool sensors are not centered. If the centralising force is too great the excessive force will induce unwanted drag which may prevent the tool descending or cause stick-slip motion of the logging tool. Stick-slip is where the tool moves up the wellbore in a series of spurts rather than at a constant velocity. Stick-slip action will compromise or possibly invalidate the acquired measurement data. The practical limit for gravity decent with using bow spring centralisers is in the order of 60 degrees from the vertical. Wellbores are vertical at shallow depths and build deviation with depth. Consequently, the centralisation force that is necessary varies within the same wellbore. As the bow spring centraliser must be configured for the highest deviations, invariably there is more drag than what is necessary over much of the surveyed interval. With bow spring centralisers, the centralising force is greater in small wellbores, as the leaf springs have greater deflection (more compressed), than in large wellbores. Consequently, stronger or multiple bowsprings are required in larger hole sizes. These centralisers usually have "booster" kits to impart more centering force in larger wellbores or those with higher deviations.

At deviations greater than 60 degrees other methods must be used to overcome the frictional forces and enable the tool string to descend in the wellbore. One method is to use a drive device (tractor) connected to the tool string. Tractors incorporate powered wheels that forcibly contact the wellbore wall in order to drive the tool string downhole. Another method is to push the tool string down hole with drill pipe or coiled tubing. These methods involve additional risk, more equipment and involve more time and therefore cost substantially more.

In order to reduce the centraliser drag, wheels may be attached to the centre of the bow spring to contact the wellbore wall. However, the fundamental problems associated with the collapse of the leafspring or over-powering persist.

Another known type of centraliser consists of a set of levers or arms with a wheel at or near where the levers are pivotally connected together. There are multiple sets of lever-wheel assemblies disposed at equal azimuths around the central axis of the device. There are typically between three and six sets. The ends of each lever set are connected to blocks which are free to slide axially on a central mandrel of the centraliser device. Springs are used force these blocks to slide toward each other forcing the arms to defect at an angle to the centraliser (and tool string) axis so that the wheels can extend radially outward to exert force against the wellbore wall. With this type of device, the centering force depends on the type and arrangement of the energising apparatus or springs. The centraliser device is typically energised by means of either axial or radial spring or a combination of both. The advantage of this type of centraliser is that drag is reduced by the wheels which roll, rather than slide along the wellbore wall.

A centraliser device may also be energised by spring devices that directly exert a radially outward force. Such spring devices may be coil springs, torsion springs or leaf springs acting between the centraliser arm and a central mandrel. With leaf springs acting on the hinged arms or coil springs arranged radially from the centraliser/tool string axis the limitations described above for the bow spring centraliser still apply. Namely, the centralising force is greater in small wellbores, where the springs undergo greater deflection, than in large wellbores. At increased well deviations, more centering force is required. If the centering force is too small the centraliser will collapse and the tool sensors are not centered. If the centralising force is too great the excessive force will induce unwanted drag which may prevent the tool descending or cause stick-slip motion of the logging tool.

The reference to any prior art in the specification is not, and should not be taken as, an acknowledgement or any form of suggestion that the prior art forms part of the common general knowledge in any country.

DISCLOSURE OF INVENTION

It is an object of the present invention to address any one or more of the above problems or to at least provide the industry with a useful device for centering sensor equipment in a bore or pipe.

According to a first aspect of the present invention there is provided a device for centering a sensor assembly in a bore, the device comprising:

a mandrel;

a first support member and a second support member axially spaced apart along a central longitudinal axis of the device, one or both of the first and second support members adapted to move axially along the mandrel;

a plurality of arm assemblies spaced circumferentially apart around the longitudinal axis of the device and connected between the first and second support members, each arm assembly comprising:

a first arm pivotally connected to the first support member by a first pivot joint having a first pivot axis, a second arm pivotally connected to the second support member by a second pivot joint having a second pivot axis, the first and second arms pivotally connected together via a third pivot joint having a third pivot axis, and wherein the third pivot axis is located on a first side of a plane coincident with the longitudinal axis of the device and the first pivot axis and the second pivot axis are located radially outside an outside diameter of the mandrel on an opposite second side of the plane, and wherein the first and second pivot joints are azimuthally aligned, and the first and second pivot joints are azimuthally misaligned from the third pivot joint by 180 degrees.

In some embodiments, the first and second pivot axes do not intersect the mandrel.

In some embodiments, the third pivot joint is radially outside the outside diameter of the mandrel.

In some embodiments, the plane is a first plane, and the first pivot joint and the second pivot joint are aligned on a second plane coincident with the longitudinal axis of the centraliser orthogonal to the first plane.

In some embodiments, the plane is a first plane, and the first, second and third pivot joints are aligned on a second plane coincident with the longitudinal axis of the centraliser orthogonal to the first plane In some embodiments, the plane is a first plane, and the first pivot joint, the second pivot joint, and the third pivot joint and/or a wheel carried by the arm assembly to contact the well bore wall are aligned on a second plane coincident with the longitudinal axis orthogonal to the first plane.

In some embodiments, each arm assembly extends or curves circumferentially around and along the longitudinal axis of the centraliser.

In some embodiments, each arm assembly extends helically around and along the longitudinal axis.

In some embodiments, the arm assemblies are circumferentially nested or intertwined together around the mandrel.

In some embodiments, the arm assemblies are arranged so that the first pivot joints and first pivot axes of the arm assemblies are aligned on a first plane orthogonal to the longitudinal axis, and the second pivot joints and second pivot axes of the arm assemblies are aligned on a second plane orthogonal to the longitudinal axis.

In some embodiments, the arm assemblies are arranged so that the third pivot joints and third pivot axes are aligned on a third plane orthogonal to the longitudinal axis.

In some embodiments, the device comprises one or more spring elements to bias the arm assemblies radially outwards. In some embodiments, the device comprises one or more spring (axial) elements acting on the first support member and/or the second support member to bias the first and second support members axially together and the arm assemblies radially outwards.

In some embodiments, the device comprises one or more (radial) spring elements acting on one or more of the arm assemblies to bias the arm assemblies radially outwards.

In some embodiments, the one or more spring elements are configured together with an angle (A):

i) between a line extending through the first and third pivot axes and the longitudinal axis being within a range, and/or ii) a line extending through the second and third pivot axes and the longitudinal axis being in a range, so that the arm assemblies each provide a substantially constant radial force for a range of well bore diameters.

In some embodiments, an angle (A):

i) between a line extending through the first and third pivot axes and the longitudinal axis, and/or ii) between a line extending through the second and third pivot axes and the longitudinal axis, is maintained in a range substantially greater than 10 degrees and substantially less than 75 degrees.

In some embodiments, the angle (A) is maintained in a range 25 degrees to 65 degrees.

In some embodiments, the centraliser is a passive device, with energisation of the arm assemblies radially outwards being provided by one or more spring elements of the device only.

In some embodiments, the mandrel comprises a plurality of facets spaced apart around an outer surface of the mandrel and the first and/or second support member has a corresponding plurality of facets spaced apart around an inner surface of the support member, to rotationally key the first and/or second support member to the mandrel.

In some embodiments, the facets are arranged so that the mandrel has a polygon shaped outer surface and the first and/or second support members has a corresponding polygon shaped inner surface.

According to a second aspect of the present invention there is provided a wireline logging tool string comprising one or more elongate sensor assemblies and a device for centering the wireline logging tool string in a wellbore during a wireline logging operation, the device as described in any one or more of the above statements.

According to a third aspect of the present invention there is provided a device for centering a sensor assembly in a bore, the device comprising:

a first support member and a second support member axially spaced apart along a longitudinal axis of the device;

a plurality of arm assemblies spaced circumferentially apart around the longitudinal axis of the device and connected between the first and second support members, each arm assembly comprising:

a first arm pivotally connected to the first support member by a first pivot joint having a first pivot axis, a second arm pivotally connected to the second support member by a second pivot joint having a second pivot axis, the first and second arms pivotally connected together via a third pivot joint having a third pivot axis, wherein the first pivot axis and the third pivot axis are located on a first side of a plane coincident with the central longitudinal axis of the device, and the second pivot axis is located on an opposite second side of the plane, and the first and second pivot joints are azimuthally misaligned by 180 degrees around the central longitudinal axis of the device.

In some embodiments, one or both of the first and second support members is adapted to move axially along the longitudinal axis to allow the arm assemblies to extend and retract radially with respect to the longitudinal axis.

In some embodiments, the first arm is a different length to the second arm, so that a distance between the second and third pivot axes is different to a distance between the first and third pivot axes.

In some embodiments, an angle between a line extending between the first and third pivot axes and the longitudinal axis is less than an angle between a line extending between the second and third pivot axes and the longitudinal axis.

In some embodiments, each arm assembly comprises a wheel to contact the wellbore wall.

In some embodiments, the wheel is rotationally coupled to the first arm or second arm on an axis of rotation perpendicular to the longitudinal axis and offset from the third pivot axis.

In some embodiments, the device comprises one or more spring elements to bias the arm assemblies radially outwards.

In some embodiments, the device comprises one or more spring (axial) elements acting on the first support member and/or the second support member to bias the first and second support members axially together and the arm assemblies radially outwards.

In some embodiments, the device comprises one or more (radial) spring elements acting on one or more of the arm assemblies to bias the arm assemblies radially outwards.

In some embodiments, the one or more spring elements are configured together with an angle (A) between a line extending through the second and third pivot axes and the longitudinal axis being in a range so that the arm assemblies each provide a substantially constant radial force for a range of well bore diameters.

In some embodiments, an angle (A) between a line extending through the second and third pivot axes and the longitudinal axis is maintained in a range substantially greater than 10 degrees and substantially less than 75 degrees.

In some embodiments, an angle (A) between a line extending through the second and third pivot axes and the longitudinal axis is maintained in a range 25 degrees to 65 degrees.

In some embodiments, the plane is a first plane, and the first pivot joint and the second pivot joint are aligned on a second plane coincident with the longitudinal axis of the centraliser orthogonal to the first plane.

In some embodiments, the plane is a first plane, and the first, second and third pivot joints are aligned on a second plane coincident with the longitudinal axis of the centraliser orthogonal to the first plane.

In some embodiments, the plane is a first plane, and the first pivot joint and the third pivot joint or a wheel carried by the arm assembly to contact the well bore wall are aligned on a second plane coincident with the longitudinal axis orthogonal to the first plane.

In some embodiments, the second arm extends circumferentially around the longitudinal axis to position the second pivot joint on the opposite side of the plane.

In some embodiments, the second arm extends helically around and along the longitudinal axis.

In some embodiments, the centraliser is a passive device, with energisation of the arm assemblies radially outwards being provided by one or more spring elements of the device only.

In some embodiments, the device has a mandrel and the first and/or second support member is adapted to move axially along the mandrel, and the mandrel comprises a plurality of facets spaced apart around an outer surface of the mandrel and the first and/or second support member has a corresponding plurality of facets spaced apart around an inner surface of the support member, to rotationally key the first and/or second support member to the mandrel.

In some embodiments, the facets are arranged so that the mandrel has a polygon shaped outer surface and the first and/or second support member has a corresponding polygon shaped inner surface.

According to a fourth aspect of the present invention there is provided a wireline logging tool string comprising one or more elongate sensor assemblies and a device for centering the wireline logging tool string in a wellbore during a wireline logging operation, the device as described in relation to the third aspect.

According to a fifth aspect of the present invention there is provided a device for centering a sensor assembly in a bore, the device comprising:

a mandrel;

a first support member and a second support member axially spaced apart along a central longitudinal axis of the device, the first and second support members adapted to move axially along the mandrel;

a plurality of arm assemblies spaced circumferentially apart around the central longitudinal axis of the device and connected between the first and second support members, each arm assembly comprising:

a first arm pivotally connected to the first support member by a first pivot joint having a first pivot axis, a second arm pivotally connected to the second support member by a second pivot joint having a second pivot axis, the first and second arms pivotally connected together via a third pivot joint having a third pivot axis, and wherein the third pivot axis is located on a first side of a plane coincident with the central longitudinal axis of the device and at least one of the first pivot axis and the second pivot axis is located on an opposite second side of the plane, and wherein the first and second pivot axes are located radially outside an outside diameter of the mandrel, and wherein:

(i) with both of the first and second pivot axes located on the second side of the plane, the first and second pivot joints are azimuthally aligned, and the first and second pivot joints are azimuthally misaligned from the third pivot joint by 180 degrees around the central longitudinal axis of the mandrel, or (ii) with one of the first and second pivot axes located on the second side of the plane, one of the first and second pivot joints is azimuthally aligned with the third pivot joint, and the first and second pivot joints are azimuthally misaligned by 180 degrees around the central longitudinal axis of the device.

According to a sixth aspect of the present invention there is provided a device for centering a sensor assembly in a bore, the device comprising:

a mandrel;

a first support member and a second support member axially spaced apart along a central longitudinal axis of the device, the first and second support members adapted to move axially along the mandrel;

a plurality of arm assemblies spaced circumferentially apart around the central longitudinal axis of the device and connected between the first and second support members, each arm assembly comprising:

a first arm pivotally connected to the first support member by a first pivot joint having a first pivot axis, a second arm pivotally connected to the second support member by a second pivot joint having a second pivot axis, the first and second arms pivotally connected together via a third pivot joint having a third pivot axis, and wherein the third pivot axis is located on a first side of a first plane coincident with the central longitudinal axis of the device and at least one of the first pivot axis and the second pivot axis is located on an opposite second side of the first plane, and wherein the first and second pivot axes are located radially outside an outside diameter of the mandrel, and wherein the first pivot joint, the second pivot joint, and the third pivot joint and/or a wheel carried by the arm assembly to contact the bore wall are aligned on a second plane coincident with the central longitudinal axis, wherein the second plane is orthogonal to the first plane.

According to a seventh aspect of the present invention there is provided a device for centering a sensor assembly in a bore, the device comprising:

a mandrel;

a first support member and a second support member axially spaced apart along a central longitudinal axis of the device, one or both of the first and second support members is adapted to move axially along the mandrel;

a plurality of arm assemblies spaced circumferentially apart around the central longitudinal axis of the device and connected between the first and second support members, each arm assembly comprising:

a first arm pivotally connected to the first support member by a first pivot joint having a first pivot axis, a second arm pivotally connected to the second support member by a second pivot joint having a second pivot axis, the first and second arms pivotally connected together via a third pivot joint having a third pivot axis, wherein the mandrel comprises a plurality of facets spaced apart around an outer surface of the mandrel and the first and/or second support member has a corresponding plurality of facets spaced apart around an inner surface of the support member, to rotationally key the first and/or second support member to the mandrel.

In some embodiments, the facets are arranged so that the mandrel has a polygon shaped outer surface and the first and/or second support member has a corresponding polygon shaped inner surface. Preferably the polygon is a regular polygon, for example the mandrel may have a hexagon or octagon shaped outer surface. In some embodiments, the outer surface of the mandrel has a facet azimuthally aligned with an adjacent first or second pivot joint at the first or second support member. The number of facets may be equal to the number of arm assemblies. The mandrel may have a facet extending between adjacent first or second pivot joints, such that the number of facets is equal to the number of arm assemblies or twice the number of arm assemblies. For example, the centraliser comprises four arm assemblies and the mandrel comprises eight facets, or an octagonal shaped outer surface and with the first and/or second support member having a corresponding octagonal shaped inner surface, or in an alternative embodiment the centraliser comprises three arm assemblies and the mandrel comprises six facets, or a hexagonal shaped outer surface and with the first and/or second support member having a corresponding hexagonal shaped inner surface.

The fifth, sixth and/or seventh aspects of the invention may include any one or more features described above for the first to fourth aspects of the invention.

In the above seven aspects of the invention, the device may be adapted for centering a wireline logging tool in a wellbore during a wireline logging operation.

Unless the context suggests otherwise, the term "wellbore" may to refer to both cased and uncased wellbores. Thus, the term 'wellbore wall' may refer to the wall of a wellbore or the wall of a casing within a wellbore.

Unless the context suggests otherwise, the term "tool string" refers to an elongate sensor package or assembly also known in the industry as a "logging tool", and may include components other than sensors such as guide and orientation devices and carriage devices attached to sensor components or assemblies of the tool string. A tool string may include a single elongate sensor assembly, or two or more sensor assemblies connected together.

Unless the context clearly requires otherwise, throughout the description and the claims, the words "comprise", "comprising", and the like, are to be construed in an inclusive sense as opposed to an exclusive or exhaustive sense, that is to say, in the sense of "including, but not limited to". Where in the foregoing description, reference has been made to specific components or integers of the invention having known equivalents, then such equivalents are herein incorporated as if individually set forth.

The invention may also be said broadly to consist in the parts, elements and features referred to or indicated in the specification of the application, individually or collectively, in any or all combinations of two or more of said parts, elements or features, and where specific integers are mentioned herein which have known equivalents in the art to which the invention relates, such known equivalents are deemed to be incorporated herein as if individually set forth.

Further aspects of the invention, which should be considered in all its novel aspects, will become apparent from the following description given by way of example of possible embodiments of the invention.

BRIEF DESCRIPTION OF THE DRAWINGS

An example embodiment of the invention is now discussed with reference to the Figures.

FIG. 2A is a side view of the centraliser with arm assemblies of the centraliser in a radially outward position corresponding with a larger wellbore diameter. FIG. 2B shows the arm assemblies in a radially inward position corresponding with a smaller wellbore diameter. FIGS. 2C and 2D are end views, with the arm assemblies in the radially outward and inward positions. FIGS. 2E and 2F are isometric type views again showing the arm assemblies in the radially outward and radially inward positions. FIG. 2G is a cross sectional view on a centreline (longitudinal axis) of the centraliser on line A-A in FIG. 2A, with the arm assemblies in the radially outward position.

FIGS. 3A to 3G Illustrate the centraliser of FIGS. 2A to 2G but with only one arm assembly shown to highlight the relative positions of pivot axes of pivot joints of the arm. FIG. 3A is a side view. FIG. 3B is another side view orthogonal to the view of FIG. 3A. FIG. 3C is a cross sectional view on a centreline (longitudinal axis) of the centraliser on line E-E in FIG. 3B. FIGS. 3D to 3F are cross sectional views on lines F-F, G-G and H-H, respectively, indicated in FIG. 3A. FIG. 3G is an isometric view.

FIG. 5A is a side view and FIG. 5B is an isometric view.

FIG. 8A illustrates a configuration having all three pivot joints and pivot axes of each arm assembly on one side of a plane coincident with the longitudinal axis of the centraliser.

FIG. 8B illustrates a configuration with a third or intermediate pivot joint and pivot axis located on a first side of a plane coincident with the longitudinal axis of the centraliser and first and second pivot joints and pivot axes at respective ends of the arm assembly on an opposite second side of the plane. FIG. 8C illustrates a configuration according to an aspect of the present invention, with a first pivot joint and pivot axis at a first end of the arm assembly and a third or intermediate pivot joint and pivot axis of the arm assembly located on a first side of a plane coincident with the longitudinal axis of the centraliser, and a second pivot joint and pivot axis at an opposite second end of the arm assembly located on an opposite second side of the plane.

FIG. 10A is a side view of the centraliser with arm assemblies of the centraliser in a radially outward position corresponding with a larger wellbore diameter. FIG. 10B shows the arm assemblies in a radially inward position corresponding with a smaller wellbore diameter. FIG. 10C is a cross sectional view on a centreline (longitudinal axis) of the centraliser on line I-I in FIG. 10A.

FIGS. 10D and 10E are isometric type views again showing the arm assemblies in the radially outward and radially inward positions.

FIG. 11A is a side view and FIG. 11B is an isometric view.

FIG. 12A is a side view of the centraliser with arm assemblies of the centraliser in a radially outward position corresponding with a larger wellbore diameter. FIG. 12B is an isometric type view again showing the arm assemblies in the radially outward position.

FIG. 13A is an isometric type view showing the arm assemblies in a radially outward position. FIG. 13B is also an isometric view but with one spring omitted to show a polygon shaped mandrel. FIG. 13C is a cross sectional view through a support member and the mandrel on a sectional line lateral to a longitudinal axis of the device.

FIG. 14A is a side view of the centraliser with arm assemblies of the centraliser in a radially outward position corresponding with a larger wellbore diameter. FIG. 14B is an end view and FIG. 14C is an isometric type view, again showing the arm assemblies in the radially outward position. FIG. 14D is a side view of the centraliser with arm assemblies of the centraliser in a radially inward position corresponding with a smaller wellbore diameter. FIG. 14E is an end view and FIG. 14F is an isometric type view, again showing the arm assemblies in the radially inward position

BEST MODES FOR CARRYING OUT THE INVENTION

Figure 1:
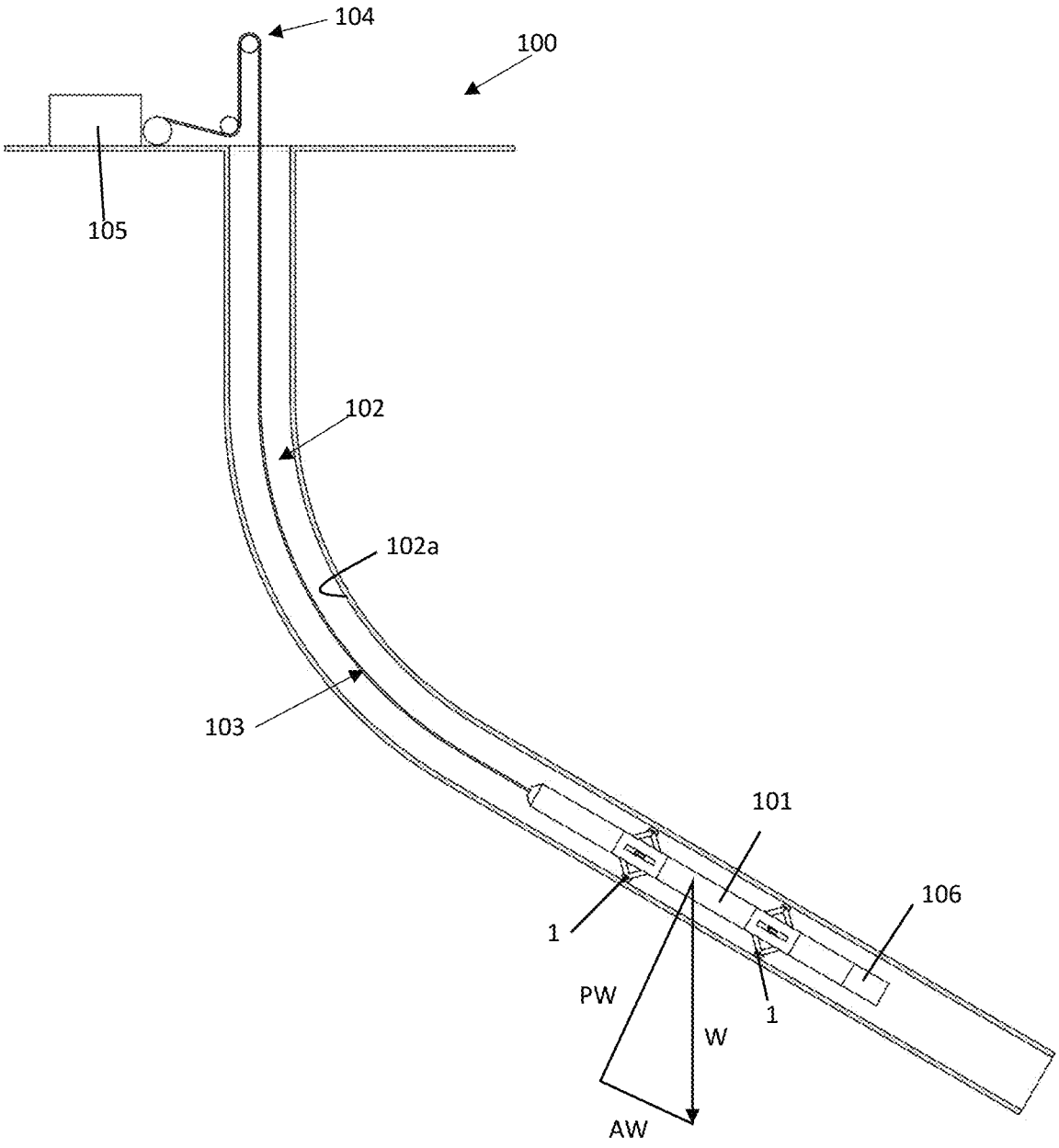
FIG. 1 is a schematic representation of a well site and a tool string descending a wellbore in a wireline logging operation.

FIG. 1 provides a schematic representation of a well site 100. A logging tool string 101 is lowered down the wellbore 102 on a wireline 103. Wellsite surface equipment includes sheave wheels 104 typically suspended from a derrick and a winch unit 105 for uncoiling and coiling the wireline to and from the wellbore, to deploy and retrieve the logging tool 101 to and from the wellbore to perform a wellbore wireline logging operation. The logging tool string 101 may include one or more logging tools each carrying one or more sensors 106 coupled together to form the logging tool string 101. The wireline 102 includes a number of wires or cables to provide electrical power to the one or more sensors 106 and transmit sensor data to the wellsite surface. One or more centralising devices 1 are provided to the logging tool 101 to centralise the logging tool 101 in the wellbore 102.

FIGS. 2A to 2G present schematic illustrations of a centralising device 1 to be provided with or as part of the tool string 101. The centralising device (or centraliser) comprises a coupling 2 or interface at each end to connect the centraliser 1 to other components of the tool string 101. The couplings may include electrical or hydraulic connections to provide electrical and hydraulic communication from the wireline to the wireline logging tool and/or between wireline tools. Alternatively, the centraliser device may be integral with the wireline logging tool, e.g. the outer housing of the logging tool may form a central mandrel of the centraliser. Alternatively, the centraliser device may slip over the outside of the wireline logging tool (housing) thereby avoiding any electrical or hydraulic connections with the tool string and wireline. The couplings or interfaces may be any suitable coupling or interface known in the art. A plurality of arm assemblies (linkages) 3 are spaced circumferentially apart around a longitudinal axis 4 of the device 1. In the illustrated embodiment there are four arm assemblies 3, however the centraliser may have three or more arm assemblies, for example five or six arm assemblies. The arm assemblies 3 are configured to move axially and radially to engage the wellbore wall 102*a* to provide a centering force to maintain the tool string 101 in the centre of the wellbore 102.

Each arm assembly or linkage 3 comprises a first arm or link 5 and a second arm or link 6. The first arm 5 is pivotally connected to a first support member 7 by a first pivot joint 9, and the second arm 6 is pivotally connected to a second support member 8 by a second pivot joint 10. The first and second arms 5, 6 are pivotally attached together by a third pivot joint 11. Each pivot joint 9, 10, 11 has a pivot pin or axle on which the arms 5, 6 pivot about a pivot axis 9*a*, 10*a*, 11*a*, being an axis of the pin or axle. One or both of the support members 7, 8 are adapted to move axially, so that each arm assembly 3 is moved radially to engage the wellbore wall 102 by pivoting of the first, second and third pivot joints 9, 10, 11. One or both support members 7, 8 may slide axially on a central member or mandrel 12 of the centraliser 1. For example, the support members 7, 8 may comprise a collar or annular member colinear with and received on the mandrel 12 to slide thereon. Each support member 7, 8 may comprise a number of parts assembled together about the mandrel 12.

The support members 7, 8 may be keyed to the mandrel to rotationally fix the support members to the mandrel so that the support members move axially on the mandrel without relative rotation between the support members and the mandrel. For example, one of the mandrel and the support member may comprise a longitudinal 'rail' or projection to engage a corresponding longitudinal channel or slot in the other one of the mandrel and support member (see for example the embodiment of FIGS. 12A and 12B described below).

Figure 4A:
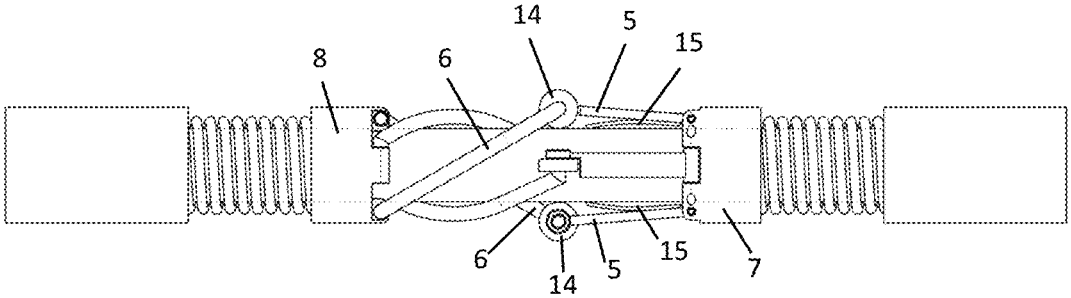
FIGS. 4A and 4B show two centralisers incorporating radially acting springs.
Figure 4B:
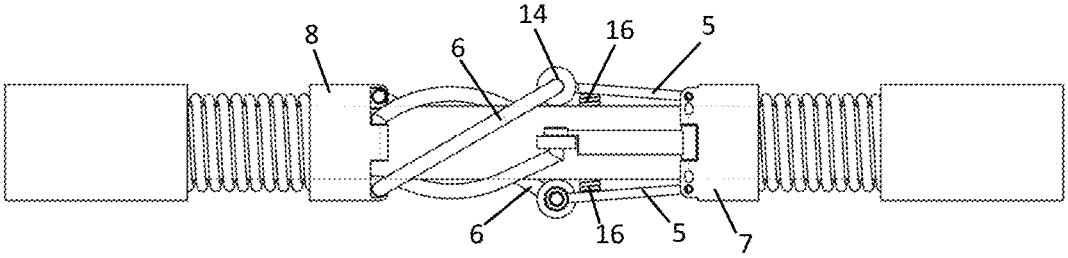

The centraliser 1 has one or more spring elements 13 to provide a force to the arm assemblies 3 to force the arm assemblies against the wellbore wall 102*a* to provide a centralising force to maintain the centraliser 1 and therefore the associated tool-string 101 centrally within the wellbore 102. In the illustrated embodiment, both of the first and second support members 7, 8 move axially, and the centraliser 1 has an axial spring 13 acting on each support member 7, 8 to bias the support members 7, 8 axially together to thereby bias the arm assemblies 3 radially outwards against the wellbore wall 102*a*. Where one of the support members 7, 8 is fixed, the centraliser 1 is without a spring acting on the fixed support. The axial spring(s) 13 may be coil springs that are colinear with the mandrel 12 as shown in the illustrated embodiment or may include a plurality of coil springs arranged circumferentially (azimuthally spaced apart) around the mandrel. Those skilled in the art will understand that other types of springs and spring configurations may be used to power the centraliser such as torsion springs, leaf springs and Belleville Washers for example. A combination of two or more spring devices may also be used, for example one or more springs may be provided end-to-end to impart a combined non-linear spring rate. Alternatively, the pitch of the coil spring may vary over its length to provide a non-linear spring rate. The centraliser may additionally or alternatively have spring elements that exert a radially outwards force directly to the arm assemblies. For example, a coil or leaf spring may be located between the first arm and the mandrel and/or between the second arm and the mandrel to provide a radially acting force, as shown in FIG. 4A (leaf springs 15) and FIG. 4B (coil springs 16). A centraliser according to the present invention may have only axial springs, only radial springs, or a combination of both axial and radial springs. A combination of both axial and radially acting springs may be used to provide a relatively constant radial force.

Figure 2A:
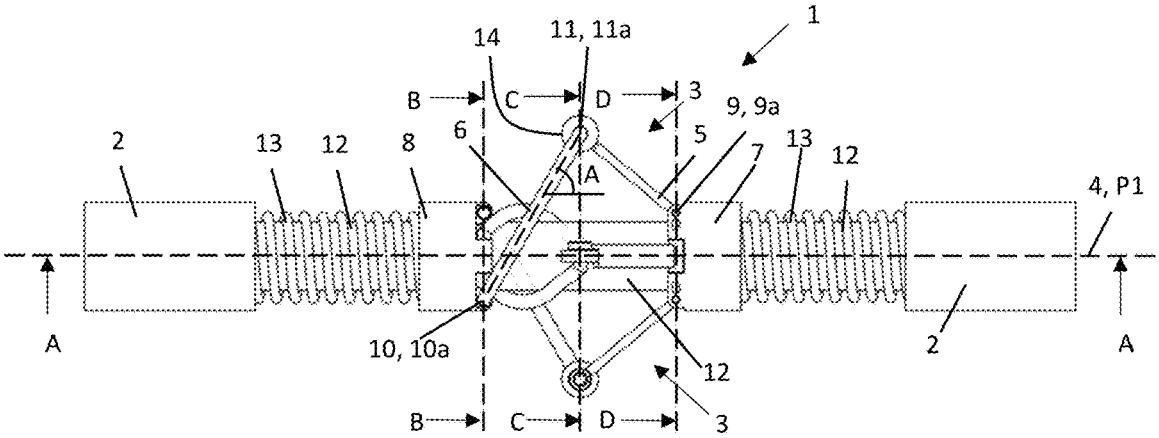
FIGS. 2A to 2G provide schematic representations of a centralising device (a centraliser) according to one embodiment of the present invention.
Figure 5A:
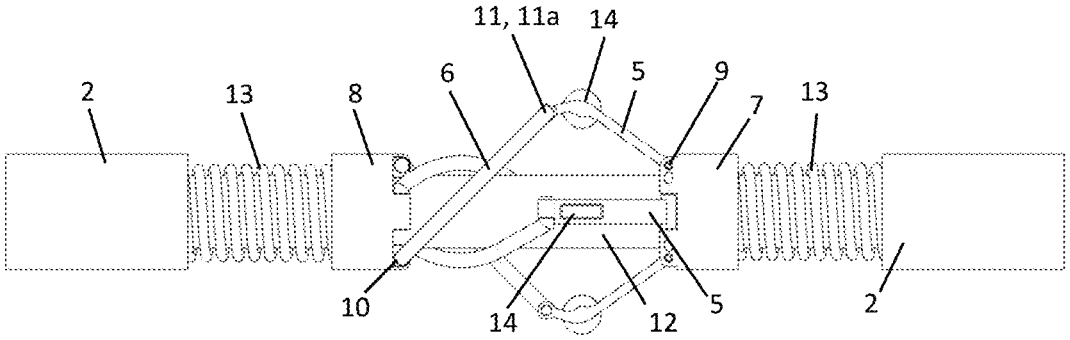
FIGS. 5A and 5B show a centraliser similar to the centraliser of FIGS. 2A and 2G but with a rotational axis of a wheel of each arm assembly offset from the third pivot joint.
Figure 5B:
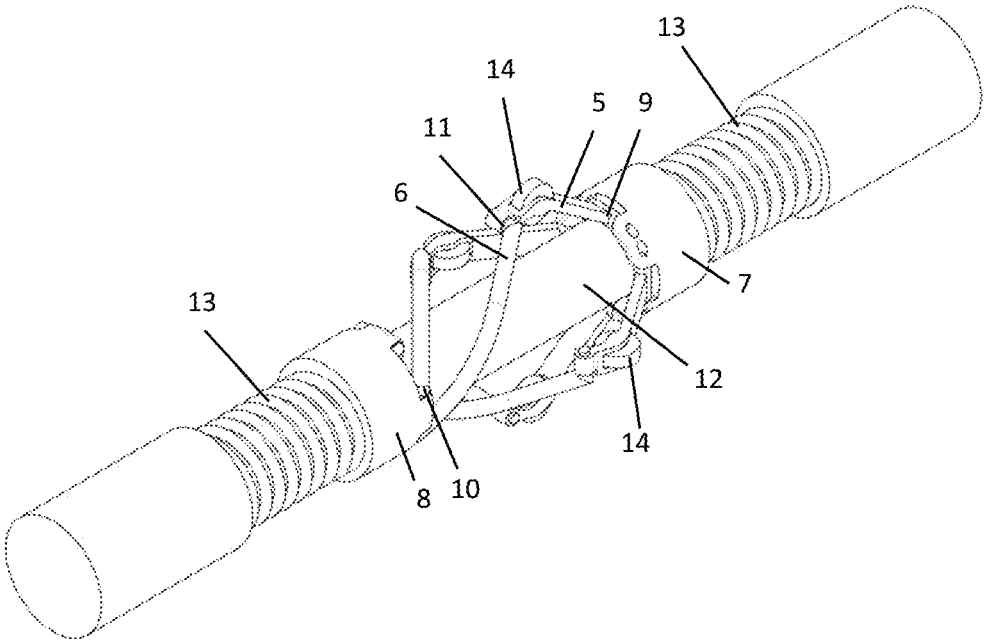

Preferably each arm assembly 3 comprises a roller or wheel 14 located at or adjacent the third pivot joint 11 to contact the wellbore wall 102*a*, to reduce friction between the wellbore wall 102*a* and the tool string 101 as the tool string 101 traverses the well bore 102. The roller 14 may have a rotational axis colinear with a pivot axis 11*a* of the third pivot joint 11 as shown in FIG. 2A, or may be located adjacent the third pivot joint 11, for example the roller may be rotationally mounted to the first arm or the second arm adjacent the third pivot joint. FIGS. 5A and 5B illustrate an embodiment with a similar configuration to the centraliser of FIGS. 2A to 2G, but with the roller 14 mounted to the first arm 5 adjacent to the third pivot axis 11*a*, with a rotational axis of the roller 14 parallel to the third pivot axis.

Figure 6:
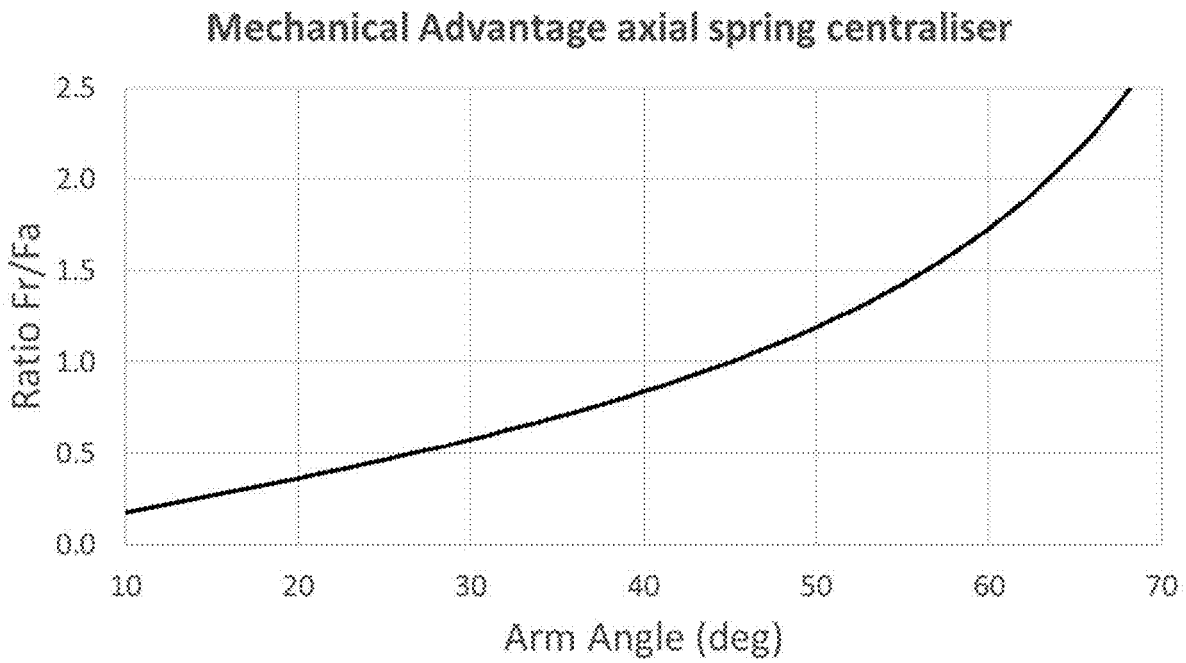
FIG. 6 provides a chart of mechanical advantage (leverage) verses angle of an arm assembly of a centraliser device, where the angle is between the arm of an arm assembly of the centraliser and the a central or longitudinal axis of the centraliser, being angle A in FIGS. 2A and 2B.

Each linkage or arm assembly 3 provides a mechanical advantage (mechanical leverage) between the axial displacement and the radial displacement to provide, in combination with the axial spring element 13, a radial force to the wellbore wall 102*a*. As the support members 7,8 are linked by multiple arm assembles 3, each arm assembly is displaced equally with support member axial displacement, thereby centralising the centraliser and toolstring in the wellbore. The mechanical advantage changes with the axial and radial position of the arm assembly 3. The mechanical advantage of the arm assembly 3 may be expressed as Fr/Fa, where Fa is the axial force provided by the axial spring element(s) 13 on the arm assembly and Fr is the resulting radial force applied to the wellbore wall 102*a*. As the mechanical advantage increases, the radial force, transferred from the axial spring force, to the wellbore wall increases. The mechanical advantage is dependent on the angle between each arm and the centreline of the device (angle A in FIGS. 2A and 2B), and increases as the angle A increases, as shown in the chart of FIG. 6 plotting the mechanical advantage vs angle A. Thus, the mechanical advantage of the arm assembly 3 increases with increasing well bore diameter. In balance with the mechanical advantage, the spring 13 provides a force that decreases with increasing wellbore diameter, since the support member 7, 8 slides axially to decompress the spring with increasing wellbore diameter. Conversely, as the wellbore diameter decreases the mechanical advantage decreases and the axial spring force increases as the spring is further compressed by the sliding support member.

It is to be understood that the angle between an arm and the central axis is defined as an angle between a line extending through the pivot axes at respective ends of the arm and the longitudinal axis. For example, the angle A between the second arm 6 and the longitudinal axis 4 is the angle A between a line extending through the second and third pivot axes 10*a*, 11*a* and the longitudinal axis 4.

Figure 7:
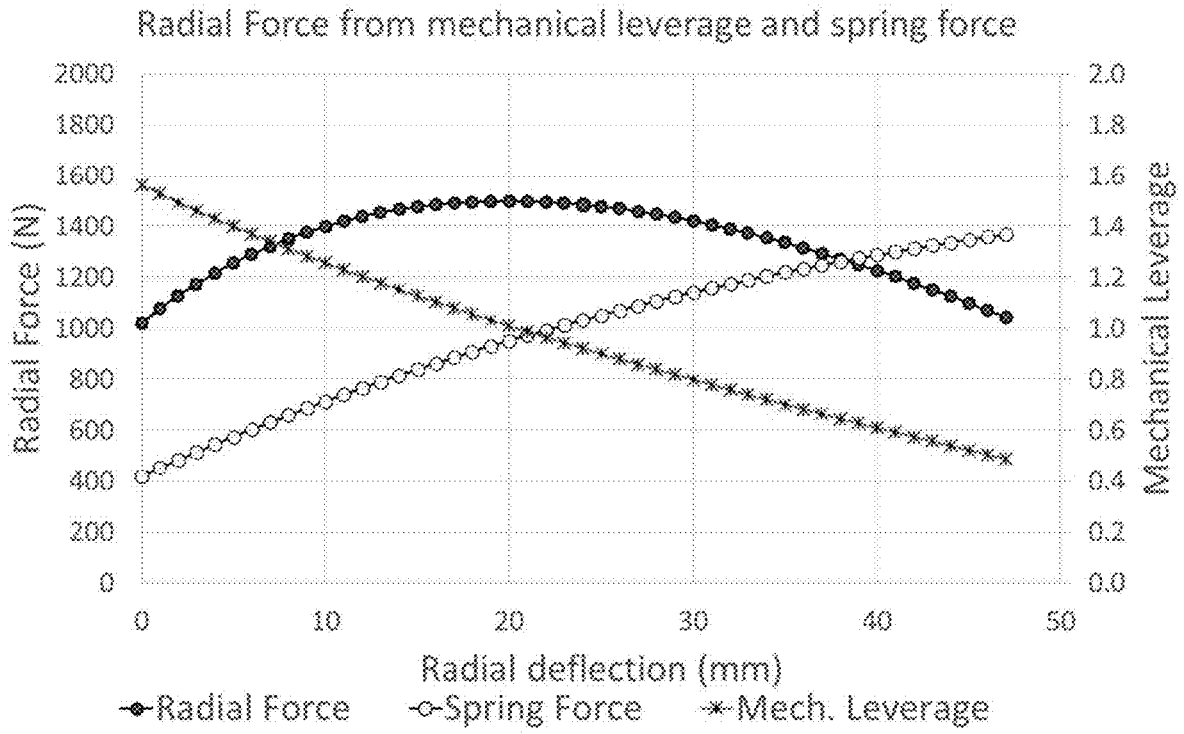
FIG. 7 provides a chart of mechanical advantage (leverage), spring force and a resulting radial force applied by an arm assembly of a centraliser according to the present invention to a well bore wall verses radial deflection of the arm assembly.

Preferably the centraliser 1 provides a relatively constant centering force over a range of wellbore diameters. The radial force applied by the centraliser 1 is a product of the axial spring force provided by spring(s) 13 and the mechanical advantage of the arm assembly 3. Since the axial force increases as the mechanical advantage decreases, a relatively constant radial force can be achieved for a range of well bore diameter sizes by optimising the spring rate, spring preload and arm assembly geometry, to balance the spring force and mechanical advantage. FIG. 7 illustrates a radial force for an axial spring centraliser designed to operate in a casing size that varies in diameter between 224 mm and 130 mm (a diameter range of 94 mm which equates to a radial range of 47 mm for each arm assembly from 112 mm to 65 mm). Within this diameter range the radial force is kept within a range of about 1000 to 1500N (224 to 336 lbf). In FIG. 7, the centering force is approximately 1250N±250N, which is considered relatively constant for the practical function of centralising a tool string 101 in a well bore 102.

To achieve a relatively constant radial force against the wellbore wall 102*a*, the angle A between the arms 5, 6 of the arm assembly 3 and the central axis 4 of the device 1 should be limited to avoid very large angles and very small angles. At large angles between the longitudinal axis 4 and an arm 5, 6 of the arm assembly 3 (angles approaching 90 degrees), a small axial spring force will result in a high radial force applied to the wellbore wall 102*a*. High radial forces can result in greater friction as the logging tool string traverses the wellbore. High friction may prevent the tool string descending under gravity and may result in stick-slip where the tool moves up the wellbore in a series of spurts rather than a constant velocity, impacting the accuracy of the data collected. When the arms are at large angles, greater radial force is required to collapse the centraliser. This make it very difficult for the centraliser to descend into a smaller diameter casing (e.g. from 9⅝ in casing to 7 in liner). The centraliser arms may even become caught in the wellhead control assembly which consists of a stack of hydraulic rams and valves for well control and safety (close in a blowout).

Conversely, at small angles between the longitudinal axis and an arm 5, 6 of the arm assembly 3 (angles approaching 0 degrees), a large axial spring force is required to provide sufficient radial force to centralise the tool string. Additionally, axial displacement of the support member(s) 7, 8 is very small relative to the radial displacement (outer diameter of the centraliser 1) which causes the centraliser device 1 to fail in its ability to centralise the tool string 101 in small diameter well bores. For example, at an arm angle of 10 degrees, a change in the centraliser diameter of 10 mm (5 mm radial displacement) results in an axial displacement of less than 1 mm. With such a small axial movement of the support members 7, 8 clearances in pivot points 9, 10, 11, bearings and the sliding support members 7, 8 causes the centraliser device to fail to centralise the tool string since the radial displacement of one of the arm assemblies is not transferred sufficiently accurately to other arm assemblies through the support members 7, 8 and pivot joints 9, 10. This results in the device 1 running off centre which in turn can cause the tool string sensors 106 to return erroneous data. At low arm angles the radial force may be increased by including radial booster springs as described above with reference to FIGS. 4A and 4B, however this will not correct the fundamental problem of centralisation. The logging tool will run off centre by a distance determined by the tool weight acting perpendicular to the well bore wall and the spring stiffness of the radial springs.

Figure 15:
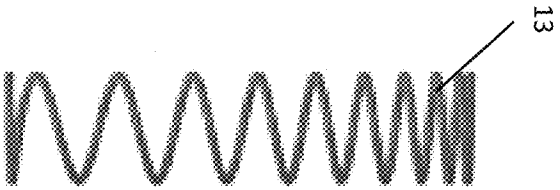
FIG. 15 shows a variable pitch coil spring configured to provide a variable spring rate.

Additionally or alternatively, a variable rate spring may be applied axially to the sliding support members 7, 8 and/or radially to each arm assembly, to provide an increased spring force at small angles between the longitudinal axis and an arm 5, 6 of the arm assembly where the mechanical advantage is reduced, and a decreased spring force at large angles between the longitudinal axis and an arm 5, 6 of the arm assembly where the mechanical advantage is increased. For example, a variable pitch coil spring may be provided axially to the sliding support members 7, 8, and/or radially between an arm 5, 6 and the mandrel, so that the spring rate increases as the coil spring is compressed. A variable pitch spring is illustrated in FIG. 15. A variable rate spring may be designed so that the varying spring rate in combination with the varying mechanical advantage provided by the arm assemblies achieves a constant radial force for a range of well bore diameters. However, centralisation at low angles presents difficulties even with variable rate springs. At low angles, large changes in wellbore diameter cause only a very small change in axial displacement of the support members 7, 8. Consequently, deflection of one arm assembly is poorly transferred via axial deflection of the support members to the other arm assemblies and the arms do not deflect in unison. When this occurs the device no longer acts to centralise the tool, the arms acting independently of each other. Extreme high precision tolerancing between parts is required to ensure all arms deflect in unison to achieve centralisation. Machining tolerances required to achieve centralisation at low arm angles may be impractical.

The inventor has identified that the angle between at least one arm of the arm assembly and the longitudinal axis should ideally be in the range of about 30° to 60°. For angles much lower than 30°, there is a decreased mechanical advantage requiring high spring loads and a resulting inability to centralise due to practical component tolerances. For angles much higher than 60°, the mechanical advantage is too great presenting increases sensitivity and high wellbore wall loading. Additionally, at angles much greater than 60°, the tool string may not be able to pass from a larger diameter casing to a smaller diameter casing as the arms 3 of the centraliser may get 'hung up' on the ledge formed between the larger and smaller diameter casing. The angle is preferably much greater than 10 degrees and much less than 75 degrees. By way of example, the radial deflection in FIG. 7 relates to an arm angle of 26° to 57°. The angle is preferably limited to a range of 20 to 70 degrees, or more preferably 25 to 65 degrees.

An improved radial range of movement may be achieved by locating the first and second pivot joints on an opposite side of a plane coincident with the longitudinal axis of the centraliser to the third pivot joint, while maintaining the angle between the arm assembly 3 and the longitudinal axis 4 between useful limits, for example 30 and 60 degrees, to achieve a relatively constant radial force.

Figure 8C:
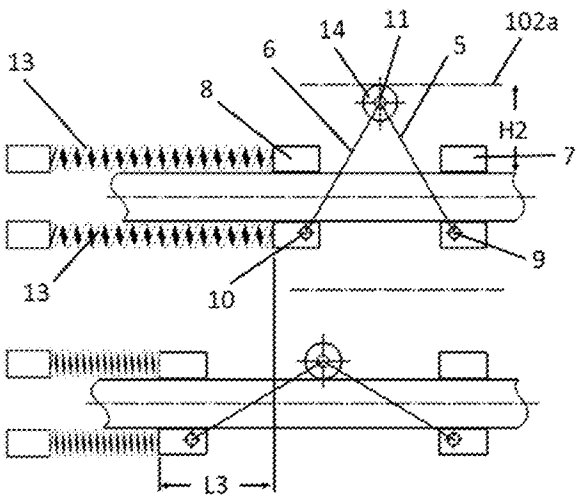
FIGS. 8A to 8C are schematic representations providing a comparison between centraliser configurations.
Figure 8B:
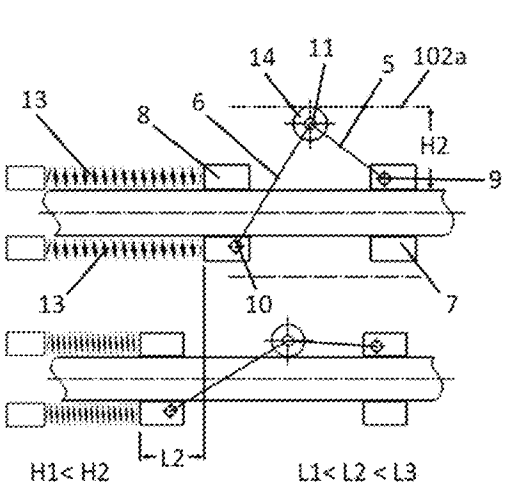
Figure 8A:
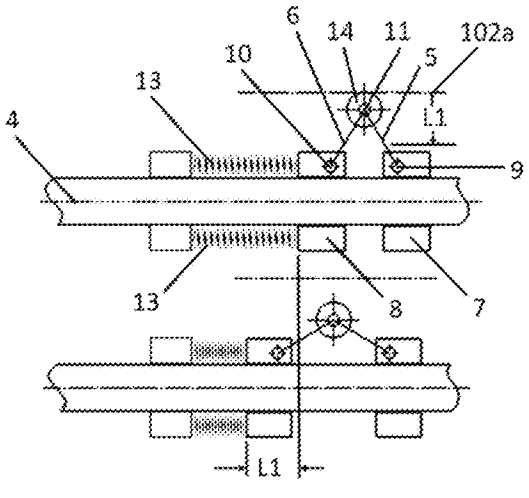

FIG. 8A provides a schematic representation of a centraliser with the first and second pivot joints 9, 10 located on the same side of a plane coincident with the longitudinal axis 4 as the third pivot joint 11 (this configuration referred to herein as 'near side' pivots). By comparison, FIG. 8C provides a schematic representation of a centraliser with the third pivot joint 11 located on a first side of a plane coincident with the longitudinal axis 4 of the centraliser and the first and second pivot joint 9, 10 located on an opposite second side of the plane (this configuration referred to herein as 'far side' pivots). This comparison between the arrangements of FIGS. 8A and 8C shows that, when limiting the angle between the arm assembly 3 and the longitudinal axis 4 between 30 and 60 degrees, the far side pivot configuration of FIG. 8C achieves a much greater radial range, and therefore provides a centraliser that can be used in a larger range of wellbore diameters. The far side pivot configuration is therefore preferred to the near side pivot configuration with respect to providing a centraliser suited to a larger range of wellbore diameters. Furthermore, to achieve the arm angle in a range of 30 to 60 degrees, the arms in the near side configuration of FIG. 8A must be relatively short. Shorter arms result in a smaller axial displacement, requiring a very stiff spring to achieve the desired radial forces necessary to centralise the tool string, which further complicates the engineering design for the device.

The inventor has determined that a benefit may be achieved by locating only one of the first and second pivot joints 9, 10 on the opposite second side of a plane coincident with the longitudinal axis of the centraliser, as shown in the schematic representation of FIG. 8B, and as incorporated in the centraliser of FIGS. 2A to 2G (this configuration referred to herein as 'mixed' side pivots). The inventor determined that a relatively constant radial force may be achieved by maintaining the angle between only one of the arms 5, 6 in the arm assembly 3 and the longitudinal axis 4 in a useful range to achieve a useful mechanical advantage. As shown in FIG. 8C, the angle between the longitudinal axis 4 and the second arm 6 with a 'far side' pivot joint (angle A in FIG. 2A), being the pivot joint 10 on the opposite side of a plane coincident with the longitudinal axis to the third pivot joint 11, remains in a useful range to achieve a radial force that is sufficiently constant over an improved radial range and therefore range of bore diameters. A comparison between FIGS. 8B and 8C shows that the mixed side pivot arrangement of FIG. 8B has the same radial range as the far side pivot arrangement of FIG. 8C. However, the radial range for the mixed side arrangement is achieved in a shorter axial change in length compared to the far side pivot arrangement. As the axial displacement is less with mixed side arrangement compared to far side arrangement, the mixed side arrangement can be engineered with a shorter, stiffer spring. The axial stroke of the support member 7 is indicated by L2 in FIG. 8B and L3 in FIG. 8C, where L2<L3. The mixed side arrangement therefore achieves a shorter length centraliser and therefore shorter length tool string, which is a significant benefit in relation to navigating a tool string down a wellbore. Additionally, this shorter length attribute allows the mixed side centraliser to be retro-fitted to replace an existing centraliser integral with the tool string, which utilise the near side arrangement, where the accommodation space is too small for the far side arrangement. Prior art centralisers with a near-side pivot configuration are often integral with the logging tool, with a body of the logging tool forming the mandrel 12 of the centraliser, or in other words, the arm assemblies 3 and support members 7, 8 of the centraliser 1 are fitted to the body of the elongate logging tool assembly. The support members 7, 8 may be fitted to reduced diameter section of the logging tool. The mixed side arrangement can be designed to fit to the logging tool string designed for a near side arrangement, by removing the incumbent near side centraliser and retro-fitting the mixed side centraliser spring(s) 13, support members 7, 8 and arm assemblies 3, to achieve improved centralisation over a larger radial range (wellbore diameter range).

Figure 9:
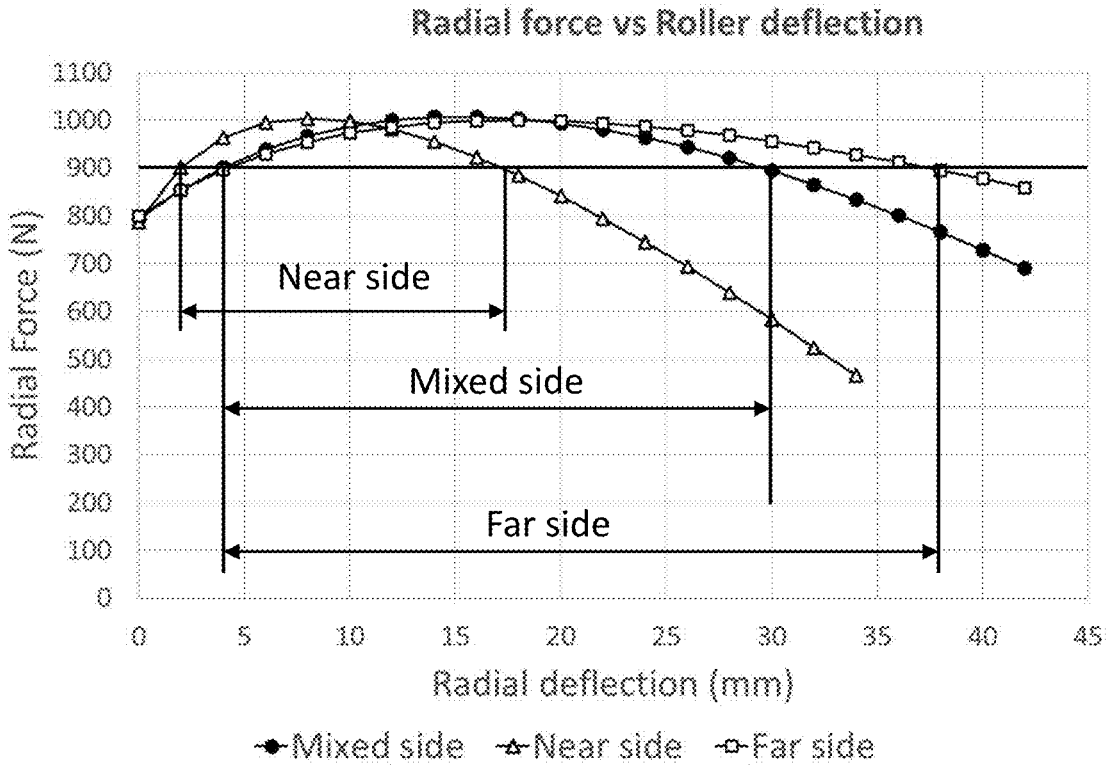
FIG. 9 provides a chart of a comparison in the radial force verses radial deflection characteristics for three centraliser devices; a centraliser with a 'near side' pivot configuration (FIG. 8A), a centraliser with a 'far side' pivot configuration (FIG. 8B), and a centraliser with a 'mixed side' pivot configuration (FIG. 8C).

FIG. 9 presents a comparison in the radial force verses radial deflection characteristics for three centraliser devices; a centraliser with a 'near side' pivot configuration (FIG. 8A), a centraliser with a 'far side' pivot configuration (FIG. 8C), and a centraliser with a 'mixed side' pivot configuration (FIG. 8B). The far side pivot configuration achieves the greatest radial deflection or range for a given radial force band, however the radial deflection or range achieved by the mixed side is significantly better than the near side configuration while achieving a reduced axial length centraliser compared to the far side configuration.

The centraliser of FIGS. 2A to 2G has a 'mixed side' pivot configuration as discussed above with reference to FIG. 8B. The first pivot joint 9 and the third pivot joint 11 are located on a first side of a plane coincident with the longitudinal axis 4 of the centraliser 1, and the second pivot joint 10 is located on an opposite second side of the plane. The first pivot joint 9 has a first pivot axis 9*a*, the second pivot joint 10 has a second pivot axis 10*a* and the third pivot joint 11 has a third pivot axis 11*a*. Axial movement of the support members 7, 8 causes the arms 5, 6 to pivot about the first, second and third pivot axes. The pivot joints 9, 10, 11 are arranged so that the first pivot axis 9*a* and the third pivot axis 11*a* are located on a first side of a plane P1 coincident with the longitudinal axis 4 of the centraliser 1, and the second pivot axis 10*a* is located on an opposite second side of the plane P1.

Figure 2B:
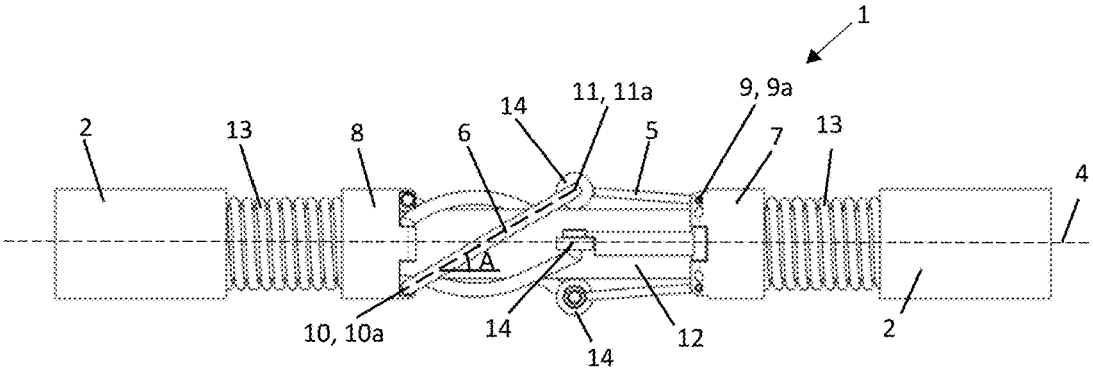
Figure 2C:
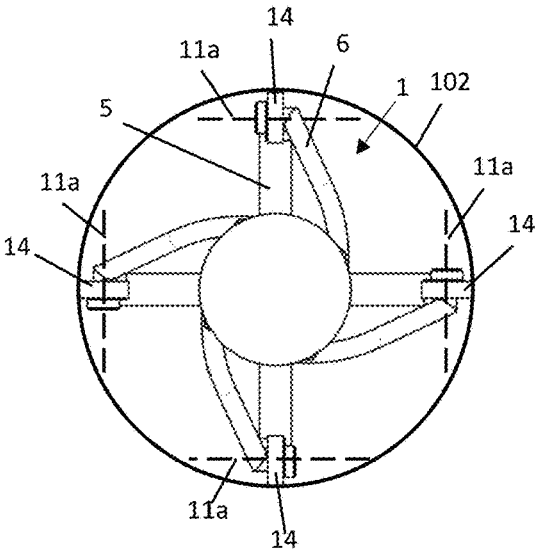
Figure 2D:
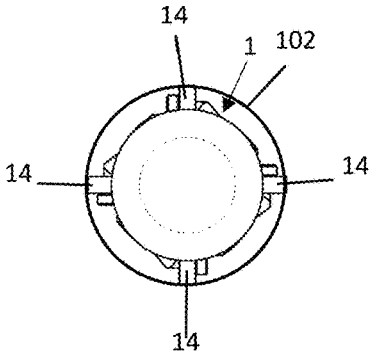
Figure 2E:
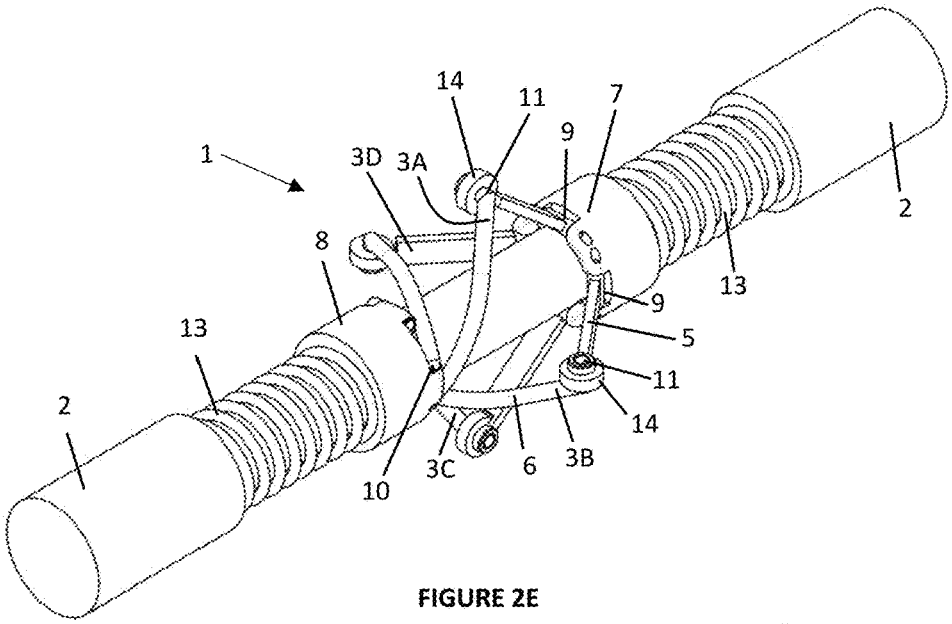
Figure 2F:
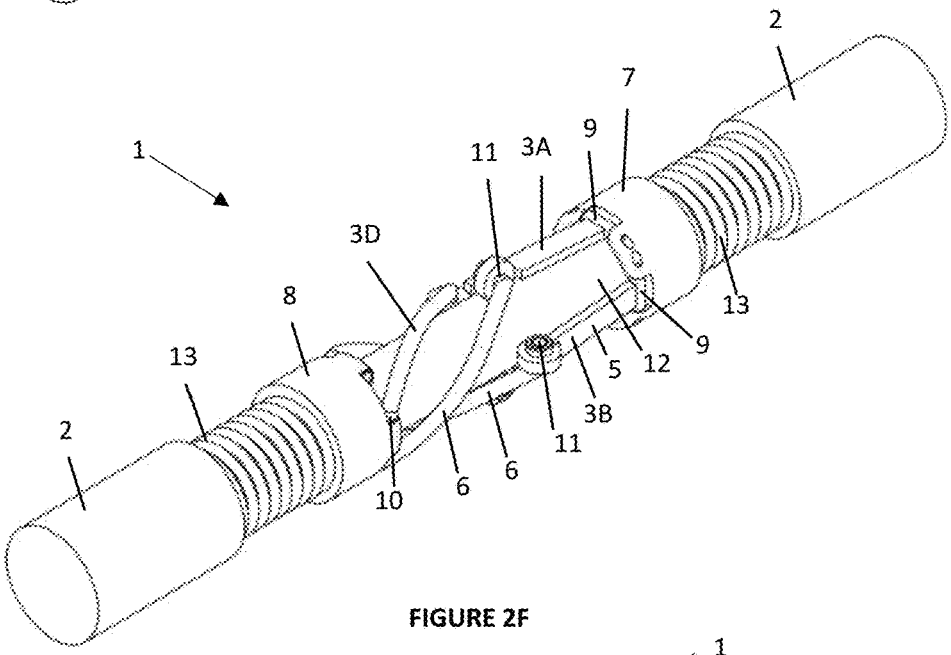
Figure 2G:
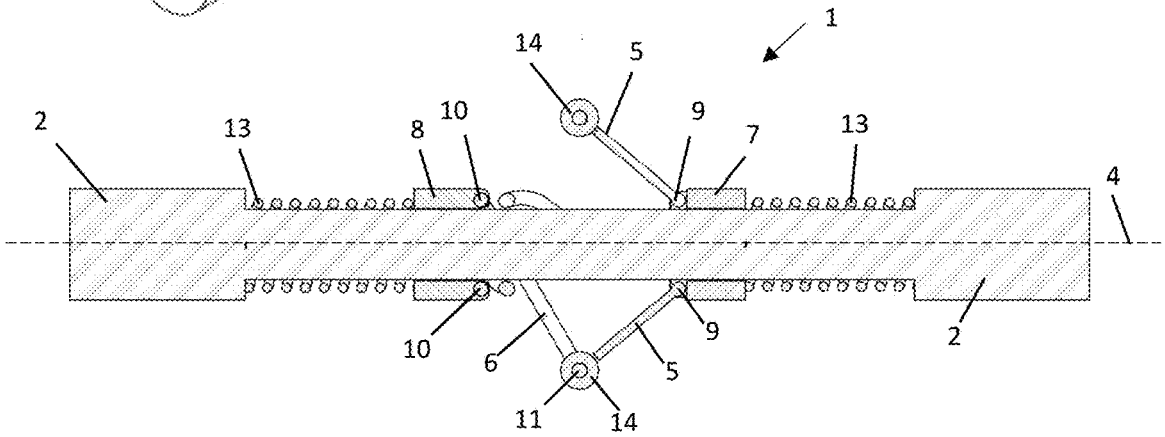
Figure 2H:
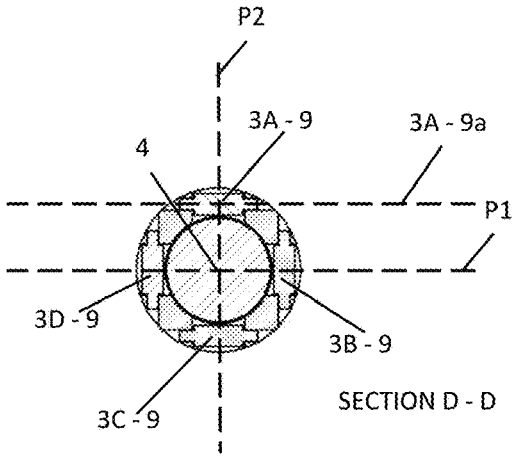
FIGS. 2H to 2J provide schematic cross sectional views on lines D-D, C-C and B-B respectively, indicated in FIG. 2A.
Figure 2I:
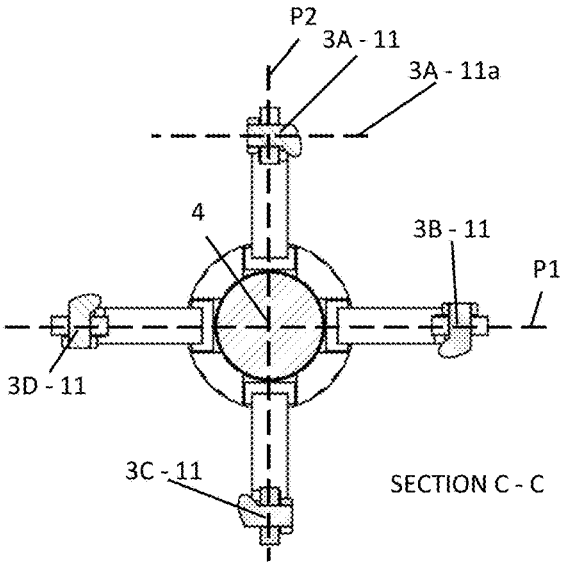
Figure 2J:
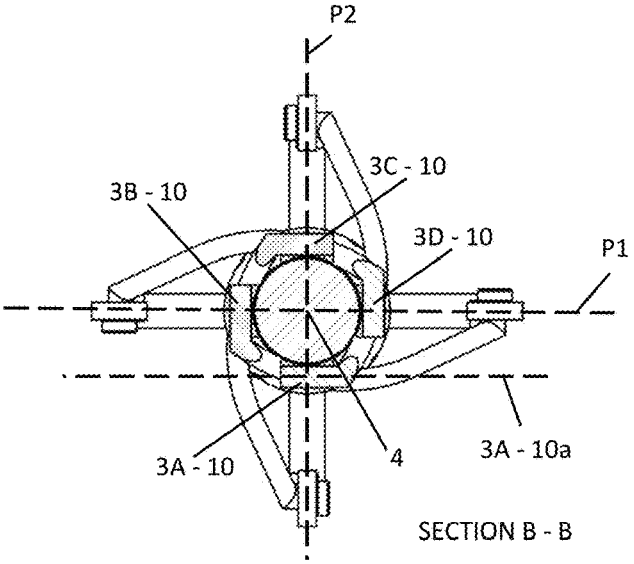

The relative positions of the first, second and third pivot joints 9, 10 and 11 in the embodiment of FIGS. 2A to 2G are further illustrated in the cross-section views of FIGS. 2H to 2J. The arm assemblies 3 are designated as arm assemblies 3A, 3B, 3C and 3D in FIGS. 2E and 2F (arm assembly 3C obscured from view in FIG. 2F). In the cross-sectional views of FIGS. 2H to 2J, the first, second and third pivot joints of arm assembly 3A are identified by reference numerals 3A-9, 3A-10 and 3A-11, with the same numbering convention applied for arm assemblies 3B, 3C and 3D.

As shown in FIGS. 2H to 2J, and with reference to arm assembly 3A, the first and second pivot joints 3A-9, 3A-10 are circumferentially spaced apart (i.e. azimuthally misaligned) by 180 degrees around the longitudinal axis 4 of the centraliser. The first pivot axis 9*a*, second pivot axis 10*a*, and the third pivot axis 11*a* are parallel. Preferably the first pivot axis 9*a*, second pivot axis 10*a*, and the third pivot axis 11*a* are perpendicular to the longitudinal axis 4 of the centraliser 1. The first pivot joint 3A-9 and the second pivot joint 3A-10 are aligned on a plane P2 coincident with the longitudinal axis 4 of the centraliser. Plane P2 is orthogonal to plane P1. The first pivot joint 3A-9 and the third pivot joint 3A-11 and/or wheel 14 may be aligned on plane P2. For example, the first arm 5 may be straight or otherwise shaped so that the first pivot joint 3A-9 and third pivot joint 3A-11 and/or wheel 14 lie on the plane P2 and are circumferentially or azimuthally aligned. The first pivot joint 3A-9 and the third pivot joint 3A-11 are located on a first side of plane P1, and the second pivot joint 10 is located on an opposite second side of the plane P1. The pivot joints 9, 10, 11 are arranged so that the first pivot axis 9*a* and the third pivot axis 11*a* are located on the first side of the plane P1 and the second pivot axis 10*a* is located on the opposite second side of the plane P1. The second arm 6 extends or curves circumferentially around and along the longitudinal axis to position the second pivot joint 3A-10 and axis 10*a* on the opposite side of the plane P1. For example, the second arm may extend helically around and along the longitudinal axis.

The lateral alignment of the pivot joints 9, 10, 11 and wheel 14 on plane P2 reduces mechanical stress on the pivot joints, for example by reducing bending moments and thrust loads on the joints 9, 10, 11.

As best shown in FIGS. 2A and 2B, the arm assemblies 3 are arranged so that the first pivot joints 9 and pivot axes 9*a* of the arm assemblies 3 are axially aligned. That is, the first pivot joints 9 and axes 9*a* of all arm assemblies 3 are aligned on a traverse plane (a plane orthogonal to the longitudinal axis 4, e.g. a first plane extending through line D-D in FIG. 2A). Similarly, the second pivot joints 10 and axes 10*a* are aligned in a traverse plane (e.g. a second plane extending through line B-B in FIG. 2A). Preferably the third pivot joints 11 and axes 11*a* are also aligned in a traverse plane (e.g. a third plane extending through line C-C in FIG. 2A).

With the first and second pivot joints and their respective axes axially aligned, the arm assemblies are circumferentially nested together around the mandrel, or in other words the arm assemblies 3 are intertwined around the mandrel 12, much like the threads in a multi-start thread are intertwined. This arrangement achieves a reduced length centraliser, compared to if the arm assemblies or diametrically opposed arm assembly pairs were spaced axially along the centraliser.

Figure 3G:
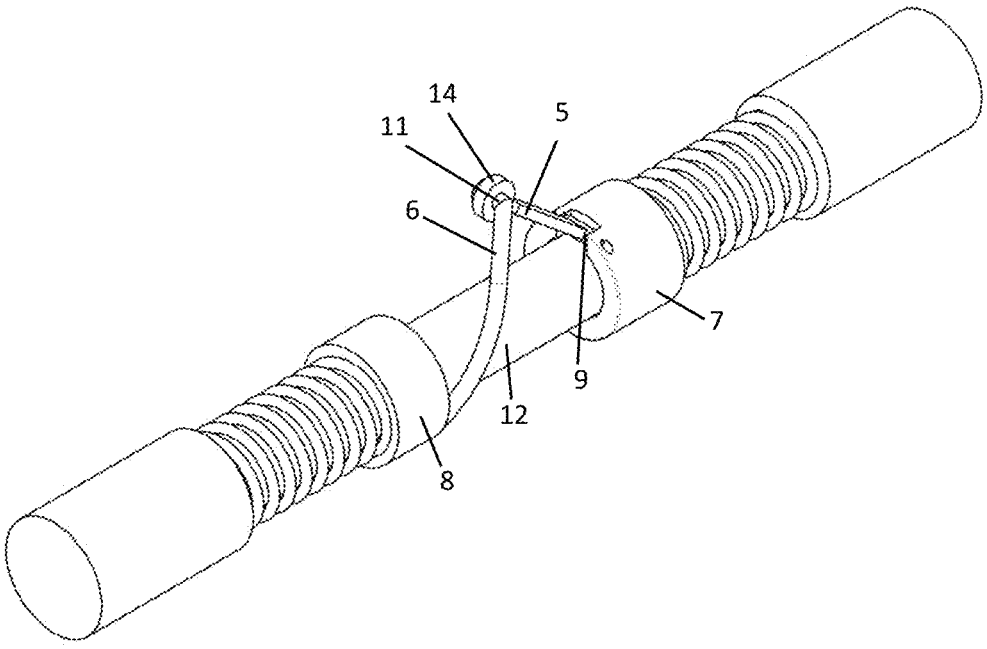

The first arm may have a different length to the second arm, so that a distance between the second and third pivot axes is different to a distance between the first and third pivot axes. For example, a distance between the first and third pivot axes 9*a*, 11*a* may be shorter than a distance between the second and third pivot axes 10*a*, 11*a*, as shown in FIGS. 2A and 3A. Alternatively, a distance between the first and third pivot axes 9*a*, 11*a* may be longer than a distance between the second and third pivot axes 10*a*, 11*a*.

With reference to FIG. 3A, the angle B between a line extending between the first and third pivot axes 9*a*, 11*a* and the longitudinal axis 4 is less than an angle A between a line extending between the second and third pivot axes 10*a*, 11*a* and the longitudinal axis 4. As the length of the first arm is increased, the angle B decreases. However, the angle A should be maintained in the preferred range (25 to 65 deg) as described above.

In an alternative arrangement, the first arm 5 may extend or curve circumferentially around the longitudinal axis 4 (for example helically), so that the first pivot joint 9 and the third pivot joint 11 are circumferentially spaced apart, i.e. azimuthally misaligned. The first pivot joint 9 may located on a first side of the plane P2, and the second pivot joint 10 may be located on an opposite second side of the plane P2. Other configurations are possible, for example, the first and second pivot joints 9 and 10 may be located on a first side of plane P2 with the first and second arms 5, 6 extending circumferentially around the longitudinal axis to position the wheel 14 on a plane (e.g. plane P2) coincident with the longitudinal axis 4.

A centraliser according to one aspect of the present invention as described above provides one of more of the following benefits. The centraliser achieves a relatively constant radial force for a larger range of wellbore diameters compared to prior art centralisers with all pivot points on the same side of the longitudinal axis as the wheel in contact with the wellbore. The centraliser achieves a wellbore diameter range comparable to a device with the arm assembly pivot joints on an opposite side of the centraliser longitudinal axis to the wheel, however, achieves the diameter range with a reduced axial length device. The configuration of the pivot joints allows a centraliser to provide a radial centering force that is not so high as to result in excess friction in smaller diameter bores within the desired wellbore range, yet provides sufficient radial force to maintain the centraliser and associated tool string centrally within larger diameter bores. A balancing of the practical mechanical advantage together with an axial spring force allows for a centraliser that can centre the tool string even in deviated wellbores where the weight of the tool string and centraliser acts against the centralisation radial force provided by the centraliser. Furthermore, the centraliser is a passive device, with energisation being provided by the mechanical spring components 13 only. No other power input, such as electrical or hydraulic power provided from service located power units is required. The invention therefore provides a lower cost, effective, and simplified device that provides improved operational reliability and accuracy of logged data.

FIGS. 10A to 10E illustrate a centraliser with a 'far-side' pivot configuration, as discussed above with reference to FIG. 8C. Features of the embodiment of FIGS. 10A to 10E that are the same as or similar to features of the above described embodiment are referenced in the drawings by the same reference numerals appearing in earlier figures and are not described again in detail with reference to FIGS. 10A to 10E.

In the embodiment of FIGS. 10A to 10E, the centraliser 20 comprises a first and second support member 7, 8 and a plurality of arm assemblies 3 connected between the first and second support members. Axial movement of one or both support members 7, 8 under the action of spring(s) 13 causes the arm assemblies 3 to move radially to engage the wellbore wall 102 by pivoting of the first, second and third pivot joints 9, 10, 11, as described above for the earlier embodiment.

However, in FIGS. 10A to 10E, each of the arm assemblies 3 comprising first arm 5 and second arm 6 is configured so that the third pivot joint 11 is located on a first side of a plane coincident P1 with the longitudinal axis 4 of the device, and the first pivot joint 9 and the second pivot joint 10 are located on an opposite second side of the plane P1. The positioning of the pivot joints 9, 10 and 11 as described and illustrated positions the third pivot axis 11*a* on the first side of plane P1 and the first and second pivot axes 9*a*, 10*a* on the opposite second side of the plane P1 (a 'far-side' pivot arrangement). The longer arm length achieves a greater radial range with a relatively constant radial force, as described above with reference to FIGS. 8A to 8C and 9.

Figure 10A:
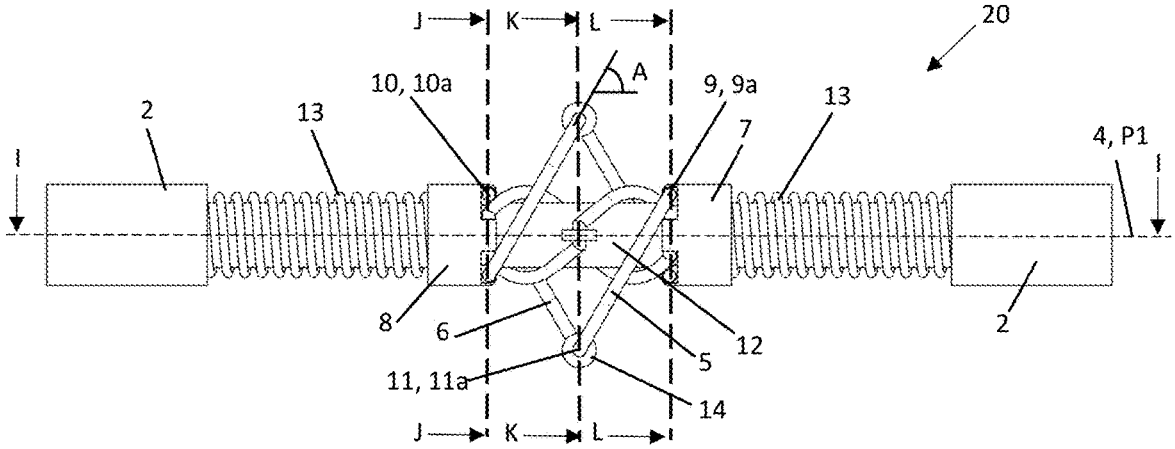
FIGS. 10A to 10E show an alternative centraliser device with a 'far side' pivot configuration.
Figure 10B:
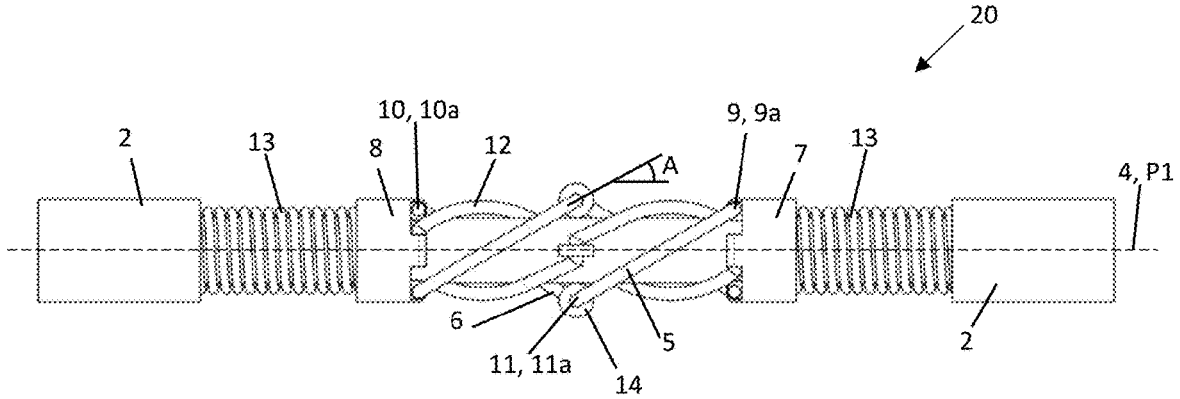
Figure 10C:
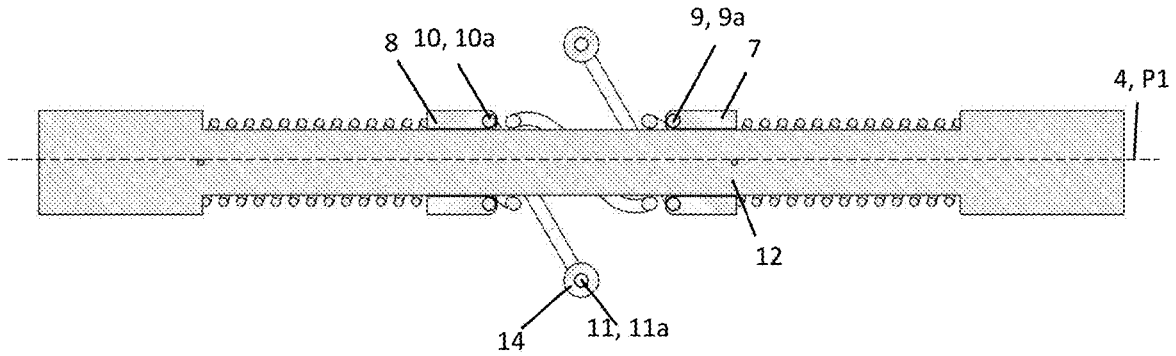
Figure 10D:
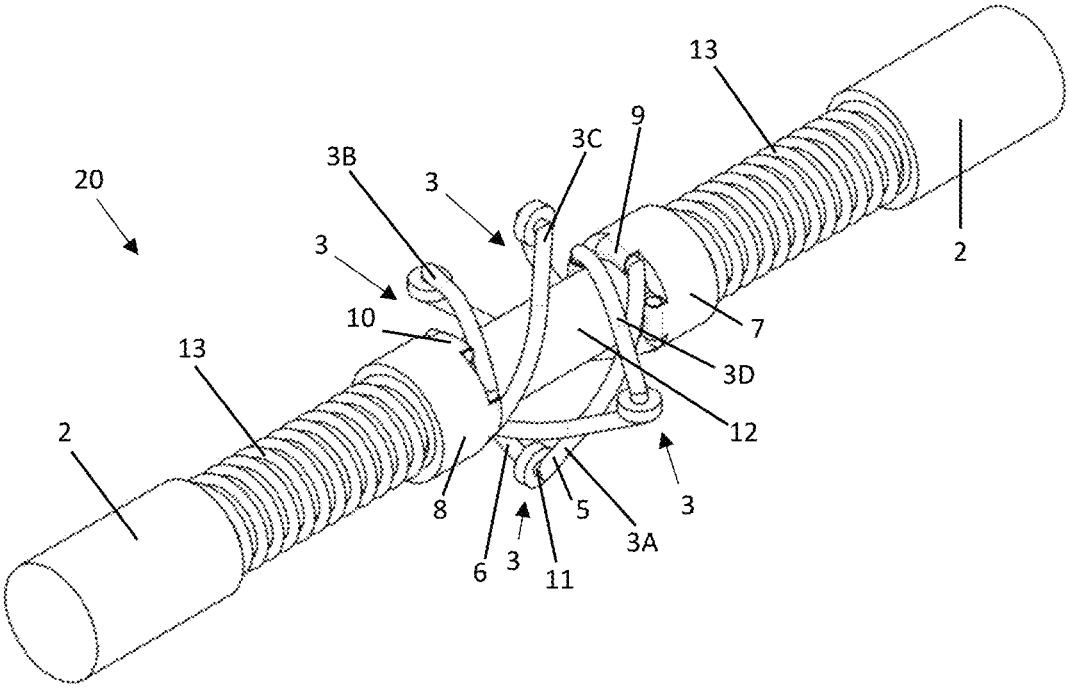
Figure 10E:
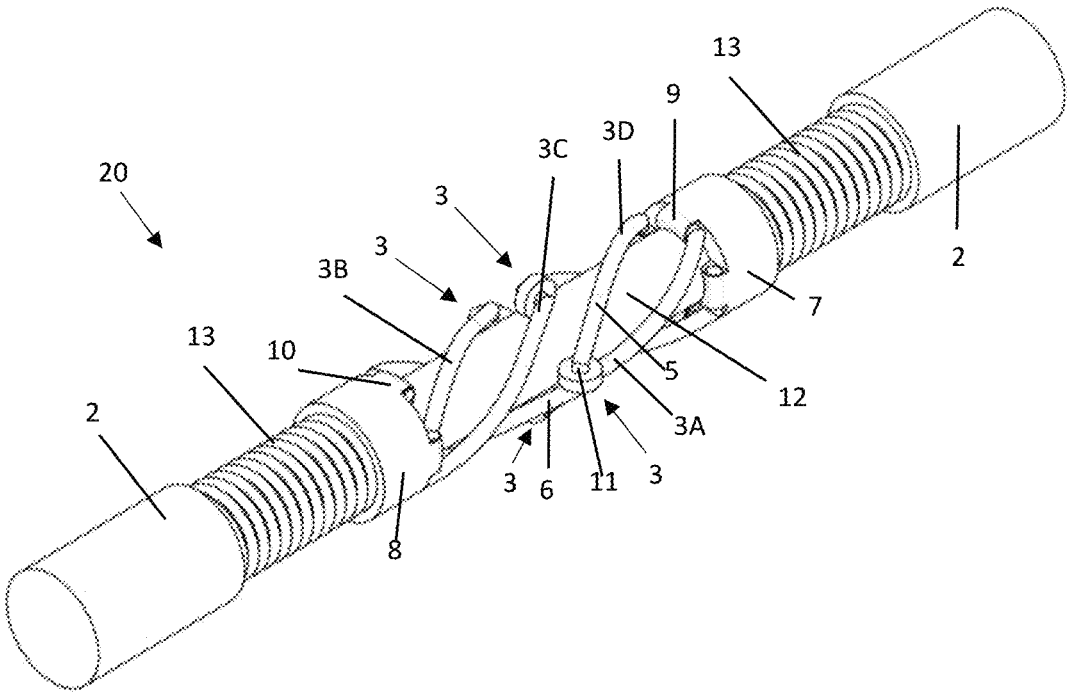
Figure 10F:
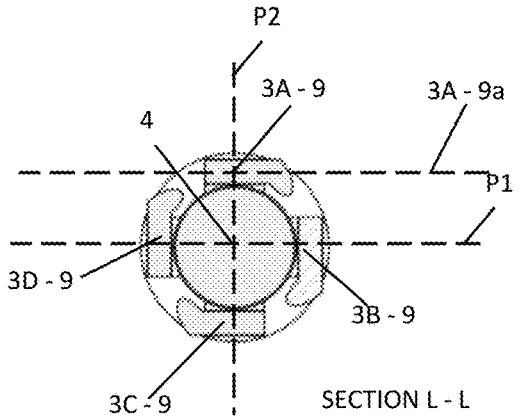
FIGS. 10F to 10H provide schematic cross-sectional views on lines L-L, K-K and respectively, indicated in FIG. 10A.
Figure 10G:
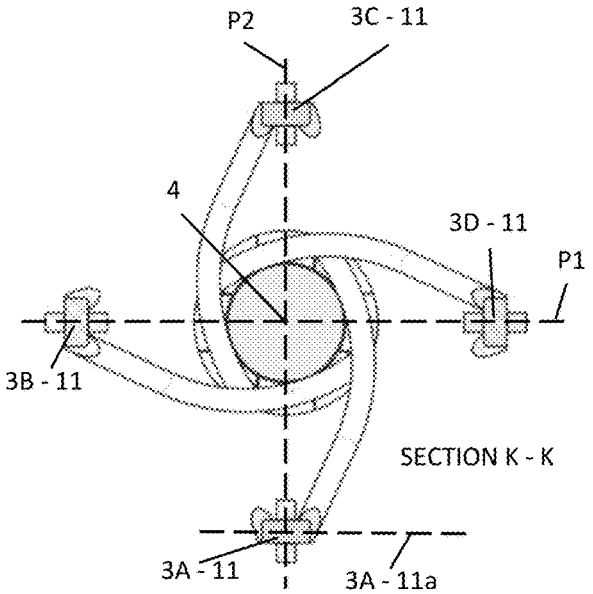
Figure 10H:
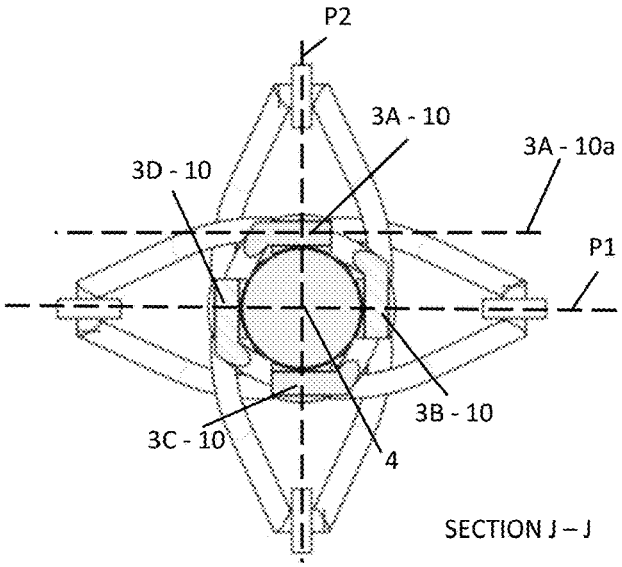
Figure 11A:
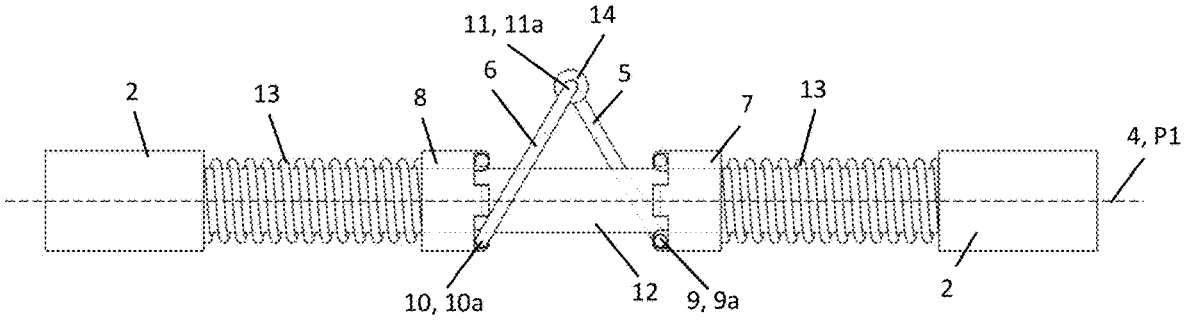
FIGS. 11A and 11B show the centraliser of FIGS. 10A to 10D but with only one arm assembly shown to highlight the relative positions of pivot axes of pivot joints of the arm.
Figure 11B:
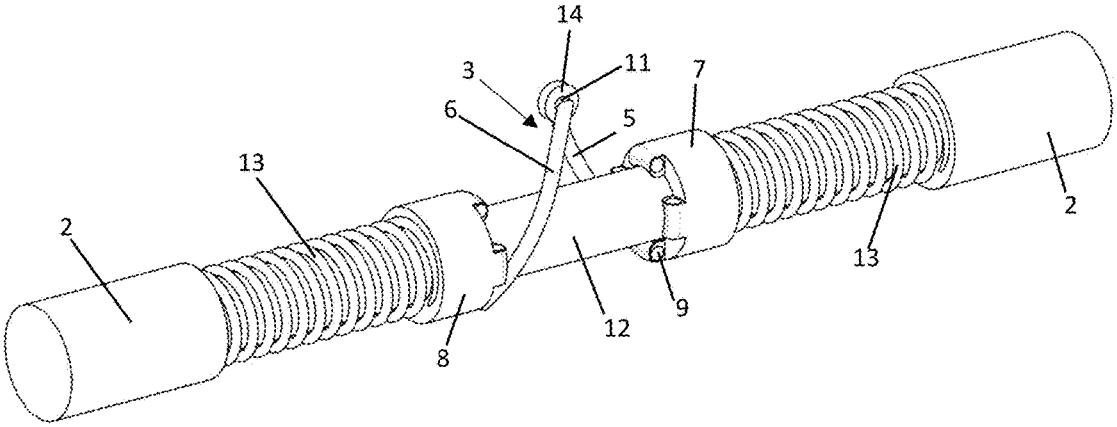

As shown in FIGS. 10F to 10H, the first and second pivot joints are azimuthally aligned. The first and second pivot joints are circumferentially spaced around the longitudinal axis 4 (azimuthally misaligned) from the third pivot joint, preferably by 180 degrees as shown. The first pivot axis 9*a*, second pivot axis 10*a*, and the third pivot axis 11*a* are parallel. Preferably the first pivot axis 9*a*, second pivot axis 10*a*, and the third pivot axis 11*a* are perpendicular to the longitudinal axis 4 of the centraliser 20. The first pivot joint 3A-9 and the second pivot joint 3A-10 are aligned on a plane P2 coincident with the longitudinal axis 4 of the centraliser. Plane P2 is orthogonal to plane P1. The first pivot joint 3A-9, second pivot joint 3A-10 and the third pivot joint 3A-11 and/or wheel 14 are aligned on plane P2. The third pivot joint 3A-11 is located on a first side of plane P1, and the first and second pivot joints 9, 10 are located on an opposite second side of the plane P1. The pivot joints 9, 10, 11 are arranged so that the third pivot axis 11*a* is located on the first side of the plane P1 and the first and second pivot axes 9*a*, 10*a* are located on the opposite second side of the plane P1. FIGS. 11A and 11B further clarify the position of the pivot joints 9, 10, 11 and pivot axes 9*a*, 10*a*, 11*a* with only one arm assembly 3 shown.

In the embodiment of FIGS. 10A to 10E, the lateral alignment of the pivot joints 9, 10, 11 and wheel 14 on plane P2 reduces mechanical stress on the pivot joints, for example by reducing bending moments and thrust loads on the joints 9, 10 and 11.

The arm assemblies extend or curve circumferentially around and along the longitudinal axis 4 of the centraliser 20. The first arm 5 extends or curves circumferentially around and along the longitudinal axis 4 between the first pivot axis 9 and the third pivot axis 11*a*, and the second arm 6 extends or curves circumferentially around and along the longitudinal axis 4 between the third pivot axis 11*a* and the second pivot axis 10*a*, to position the first and second pivot joints 9 and 10 on the opposite side of the plane P1 to the third pivot joint 11. For example, the first and second arms and therefore arm assemblies 3 may extend helically around and along the longitudinal axis.

In the embodiment of FIGS. 10A to 10E, the arm assemblies 3 are arranged so that the first pivot joints 9 and pivot axes 9*a* of the arm assemblies 3 are axially aligned, i.e. the first pivot joints 9 and axes 9*a* of all arm assemblies 3 are aligned on a traverse plane (a plane orthogonal to the longitudinal axis 4, e.g. aligned on a first plane extending through line L-L in FIG. 10A), and similarly, the second pivot joints 10 and axes 10*a* are aligned in a traverse plane (e.g. aligned on a second plane extending through line L-L in FIG. 10A). Preferably the third pivot joints 11 and axes 11*a* are also aligned in a traverse plane (e.g. aligned on a third plane extending through line K-K in FIG. 10A).

With the first and second pivot joints and their respective axes axially aligned, the arm assemblies are circumferentially nested together around the mandrel, or in other words the arm assemblies 3 are intertwined around the mandrel 12, much like the threads in a multi-start thread are intertwined. This arrangement achieves a reduced length centraliser, compared to if the arm assemblies or diametrically opposed arm assembly pairs were spaced axially along the centraliser.

A greater radial range is further achieved by positioning the first and second pivot joints 9, 10 (and their respective axes 9*a*, 10*a*) radially outside an outside diameter of the central mandrel 12 of the centraliser, to position the first and second pivot axes as far from the longitudinal axis 4 and the third pivot axis as possible. This provides for a longer arm 5, 6 and greater radial range (well bore diameter range) for a given range of angle (A) between the first and second arm 5, 6 and the longitudinal axis 4 of the device. As best shown in the cross section of FIG. 10C, the first and second pivot axes 9*a*, 10*a* do not intersect the mandrel 12. The third pivot joint is also radially outside the outside diameter of the mandrel for a full radial range of movement of the arm assembly, i.e. the third pivot joint is outside the outside diameter of the mandrel even when the arm assembly is in a radially inner most position, as shown in FIG. 10B. The third pivot joint does not intersect the mandrel 12, even in the radially inner most position.

Similarly, as shown in FIGS. 2A, 2B and 2G, in the earlier described embodiment, the second pivot joint 10 and axis 10*a* is located radially outside of an outside diameter of the central mandrel 12 of the centraliser. The second pivot axis does not intersect the mandrel 12. The first pivot joint 9 and axis 9*a* is also outside the outside diameter of the mandrel 12. The first pivot axis does not intersect the mandrel 12.

Figure 12A:
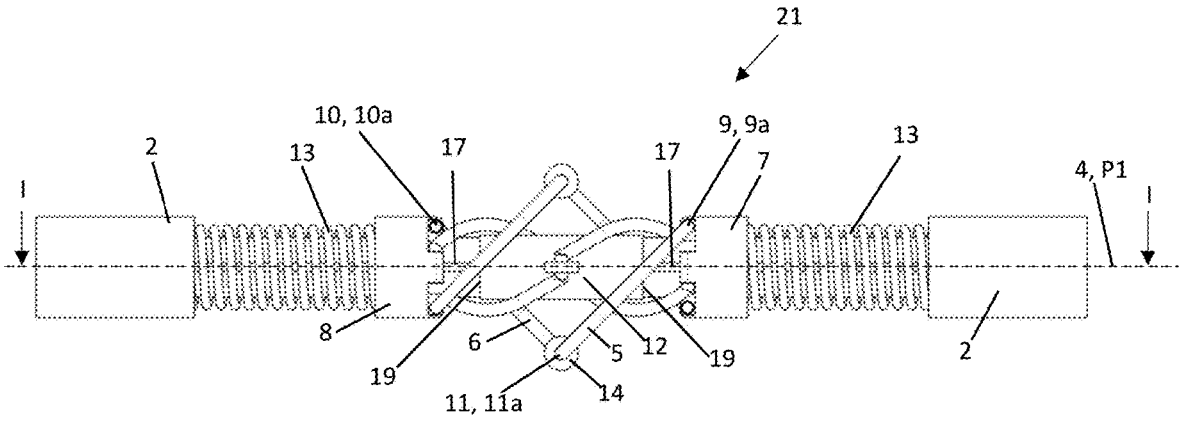
FIGS. 12A and 12B show an alternative centraliser device with a 'far side' pivot configuration.
Figure 12B:
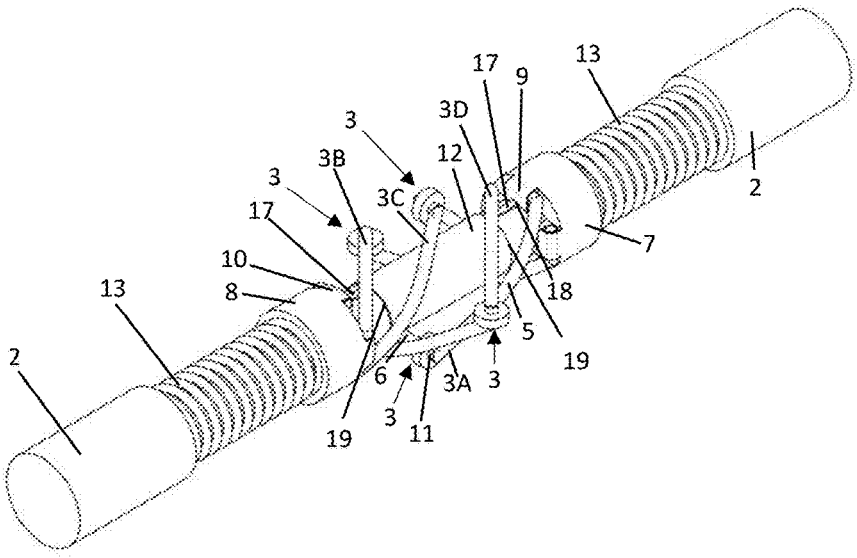

FIGS. 12A and 12B show another embodiment of a centraliser 21 with a 'far-side' pivot configuration similar to the embodiment 20 of FIGS. 10A to 10E described above, however additionally includes the support members 7, 8 keyed to the mandrel 12 to rotationally fix the support members 7, 8 to the mandrel 12 so that the support members 7, 8 move axially on the mandrel 12 without relative rotation between the support members 7, 8 and the mandrel 12. The mandrel 12 includes a longitudinal 'rail' or projection 17 to engage a corresponding longitudinal channel or slot (18 in FIG. 12B) in the respective support member 7, 8. One skilled in the art will understand the male/female sense of the keying arrangement 17, 18 between the support member 7, 8 and mandrel 12 may be reversed, i.e. the support member 7, 8 may comprise a longitudinal 'rail' or projection 17 to engage a corresponding longitudinal channel or slot 18 in the mandrel 12. The keying arrangement 17, 18 ensures the first, second and third pivot joints 9, 10, 11 and wheel 14 remain aligned on a plane coincident with the longitudinal axis of the centraliser (e.g. plane P2 in FIGS. 2H to 2J and FIGS. 10F to 10H).

The embodiment 21 of FIGS. 12A and 12B also includes mechanical stops 19 to set a maximum diameter for the centraliser 21. Each stop 19 limits axial movement of the respective support member 7, 8, to limit the radial outward movement of the arm assemblies 3. Where the centraliser 21 enters a large diameter section of a wellbore, such as a washout section, the mechanical stops 19 prevent the arm assemblies 3 extending radially outside a desired range, to avoid for example difficulties with the centraliser 21 passing from the larger diameter washout section to a smaller (or nominal) diameter section of the wellbore. One skilled in the art will understand that other methods may be used to limit the maximum diameter for the centraliser 21. For example, each support member 7, 8 may include a 'bumper' so that contact between the bumpers of the support members keep the support members a distance apart corresponding to a maximum radial position of the arm assemblies.

Figure 13A:
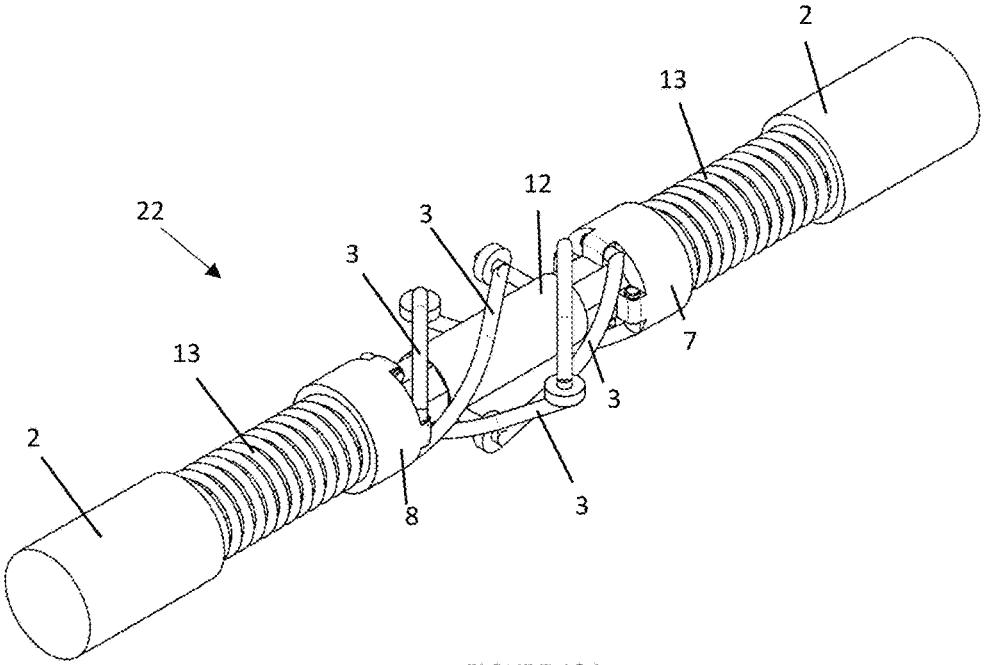
FIGS. 13A to 13C show an alternative centraliser device with a 'far side' pivot configuration.

FIG. 13A illustrates another embodiment of a centraliser 22 with a 'far-side' pivot configuration similar to the embodiment 20 of FIGS. 10A to 10E described above, but additionally including the support members 7, 8 keyed to the mandrel 12 to rotationally fix the support members 7, 8 to the mandrel 12 so that the support members 7, 8 move axially on the mandrel 12 without relative rotation between the support members 7, 8 and the mandrel 12. The mandrel 12 of the centraliser will often be hollow to accommodate wiring and the external wellbore pressures in the wellbore can be very high, for example 30,000 psi. A keyway groove in the mandrel will cause a 'stress riser' (increased local stress) in the mandrel 12 which may result in the mandrel collapsing under pressure. To reduce an increased stress in the mandrel the keyway may be provided to the support members 7, 8 with a corresponding key or rail on the mandrel, as in the embodiment of FIGS. 12A and 12B.

However, the necessary radial height of the keyway may be difficult to accommodate in the support members 7, 8 and/or the radial height of the key on the mandrel requires significant additional machining of material in the manufacture of the mandrel. To address these issues, in some embodiments and as shown in FIG. 13A, the keying of the support members to the mandrel is provided by the mandrel having a plurality of facets (flat surfaces) spaced apart around an outer surface of the mandrel. Each facet extends for at least a portion of the length of the mandrel on which the first and/or second support member moves. The support members 7, 8 have a corresponding plurality of facets spaced apart around an inner surface of the support member, to rotationally key the support members to the mandrel to prevent rotation and allow the support members to slide or move axially on the mandrel. Each facet may be tangential to a circular curve centred on the central longitudinal axis of the mandrel/device.

Providing a multi-faceted surface to the mandrel avoids a stress riser caused by a keyway in the mandrel and requires less radial height for a keyway to be accommodated in the support members.

Figure 13B:
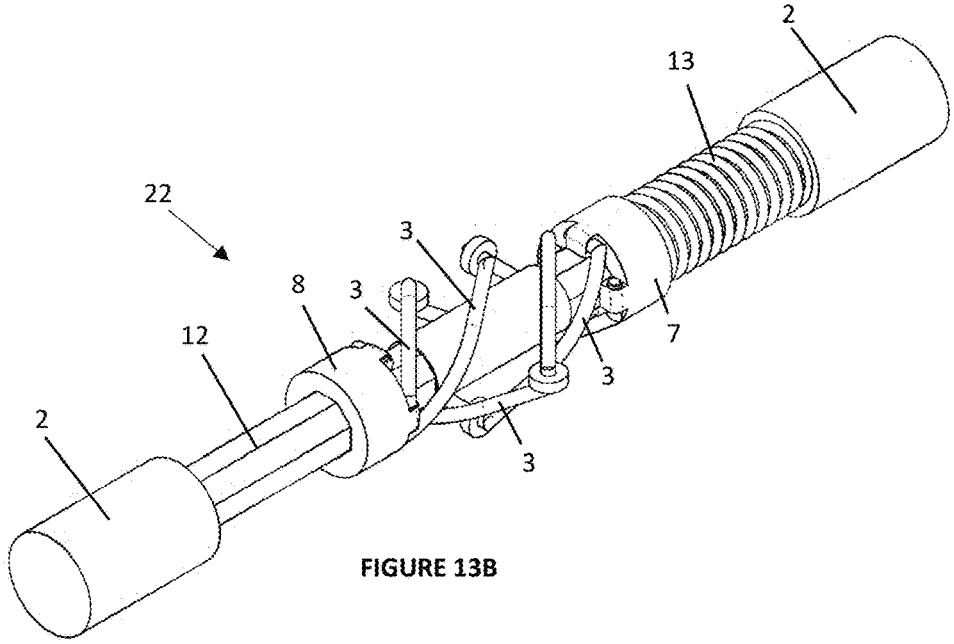
Figure 13C:
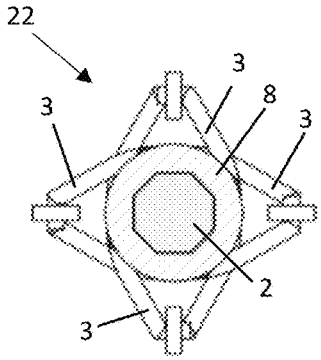

In the illustrated embodiment of FIG. 13A, the facets are arranged to provide the mandrel with a polygon shaped outer surface with the support members 7, 8 having a corresponding polygon shaped inner surface to rotationally key the support members to the mandrel to prevent rotation and allow the support members to slide or move axially on the mandrel. FIG. 13B shows the centraliser 22 with one spring 13 omitted to illustrate the facets and polygon shaped outer surface of the mandrel 12 on which the support member 8 slides. FIG. 13C shows the facets and polygon shaped outer surface of the mandrel and the corresponding polygon shaped inner surface of the support member 8. A polygon shaped outer surface is also provided to the mandrel for the first support member 7, partially obscured from view by the spring. In the embodiment of FIG. 13A the polygon is octagonal however one skilled in the art will appreciate other polygon shapes are possible, with more or less facets than eight sides. It is envisaged that the mandrel and support member(s) may have at least two facets (e.g. diametrically opposed) to key the mandrel and support member(s) together. However, in a preferred embodiment, the outer surface of the mandrel has a facet azimuthally aligned with an adjacent first or second pivot joint at the first or second support member. Alternatively, or additionally, the mandrel may have a facet extending between adjacent first or second pivot joints, such that the number of facets is equal to the number of arm assemblies or twice the number of arm assemblies. For example, in the illustrated embodiment comprising four arms, the mandrel comprises eight facets, or an octagonal outer shape. By example, a centraliser comprising three arm assemblies may have a mandrel with a hexagonal shaped outer surface and with the first and/or second support member having a corresponding hexagonal shaped inner surface.

In the illustrated embodiment, a portion of the mandrel located between the first and second support member has a larger outer cross section than the faceted portions of the mandrel to provide mechanical stops to set a maximum diameter for the centraliser. Each stop limits axial movement of the respective support member 7, 8, to limit the radial outward movement of the arm assemblies.

The facetted surface(s) of the mandrel and support member(s) achieves keying of the support member(s) to the mandrel while being stronger and also requiring less material to be machined from a stock material during manufacture of the mandrel. One skilled in the art will appreciate a centraliser with a mixed side configuration as described above or any other lever arm type centraliser may also have a facetted mandrel and support members as described with reference to FIGS. 13A to 13C to key the support member(s) to the mandrel.

One skilled in the art will understand that a mandrel with a polygon shaped outer surface has a cross section with a constant polygon outer shape extending for at least a portion of the length of the mandrel. Likewise, a support member with a polygon shaped inner surface has a cross section with a constant polygon inner shape extending for a length of the support member.

Figure 14A:
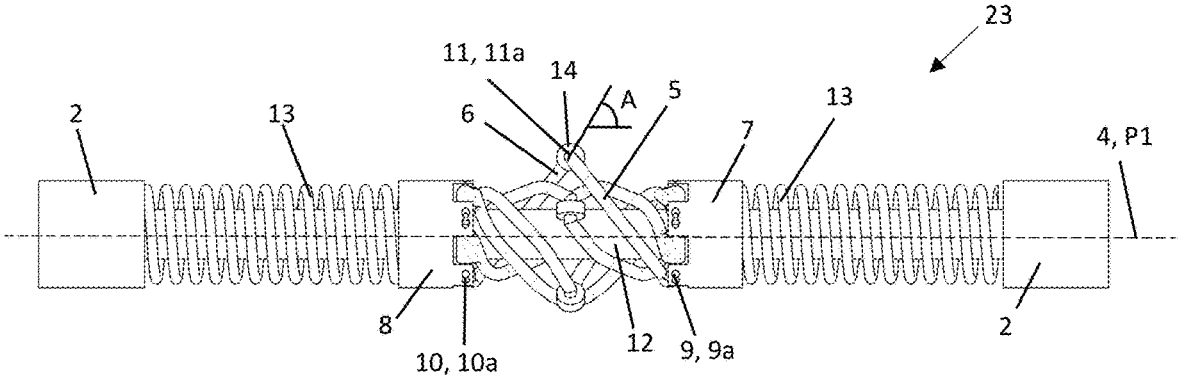
FIGS. 14A to 14F show an alternative centraliser device with 5 arms with a 'far side' pivot configuration.
Figure 14B:
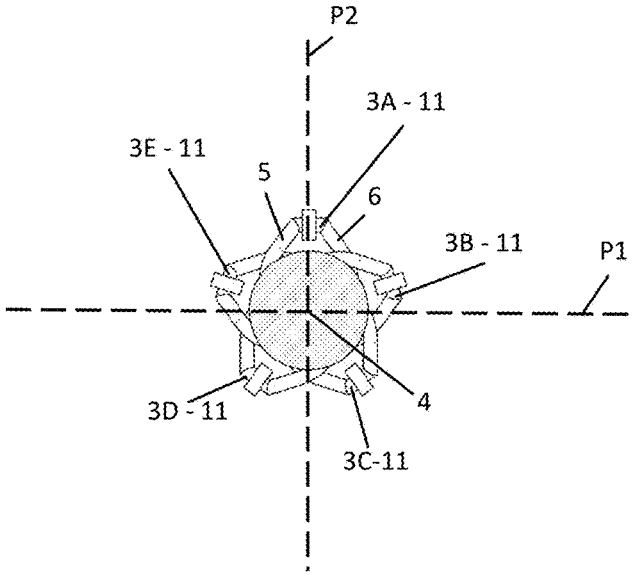
Figure 14C:
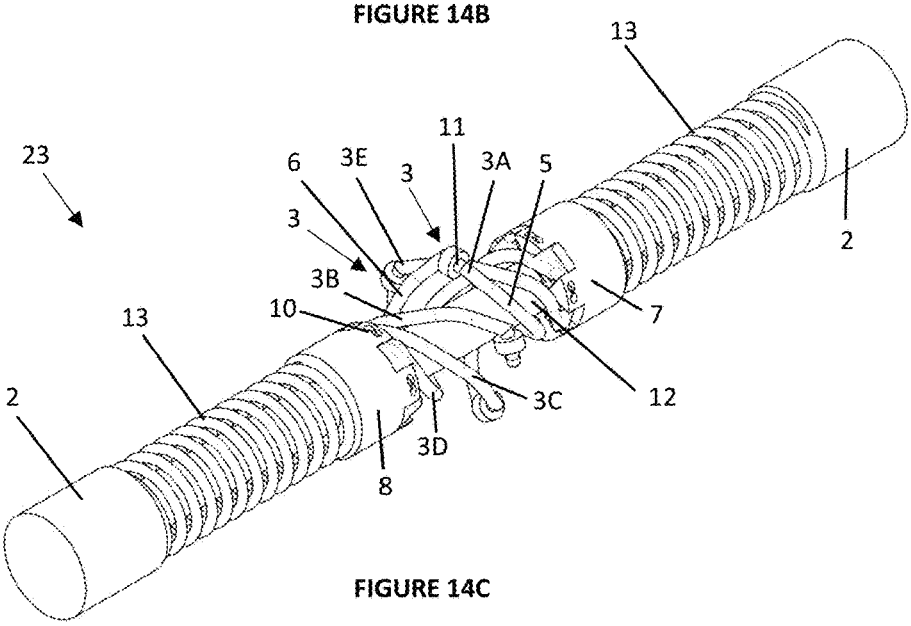
Figure 14D:
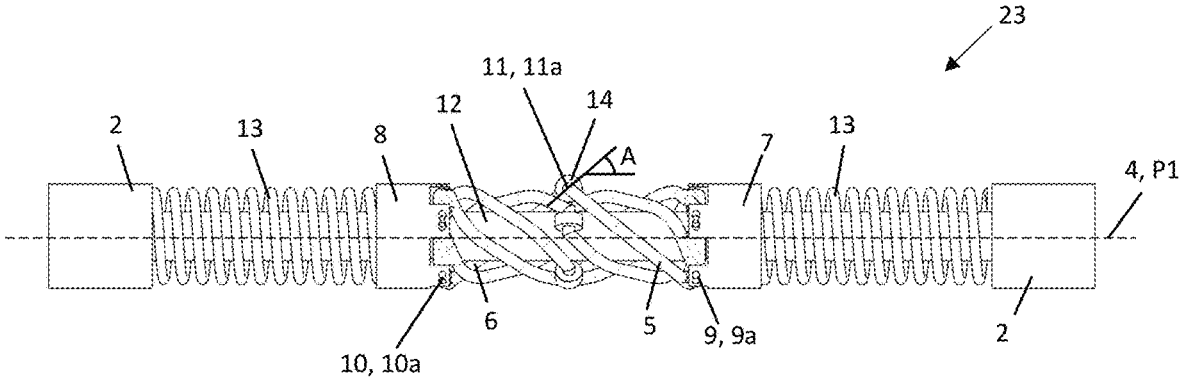
Figure 14E:
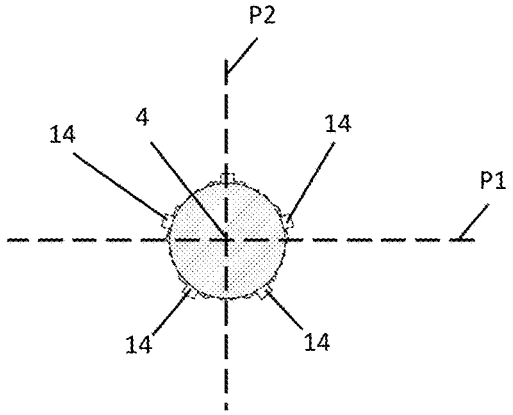
Figure 14F:
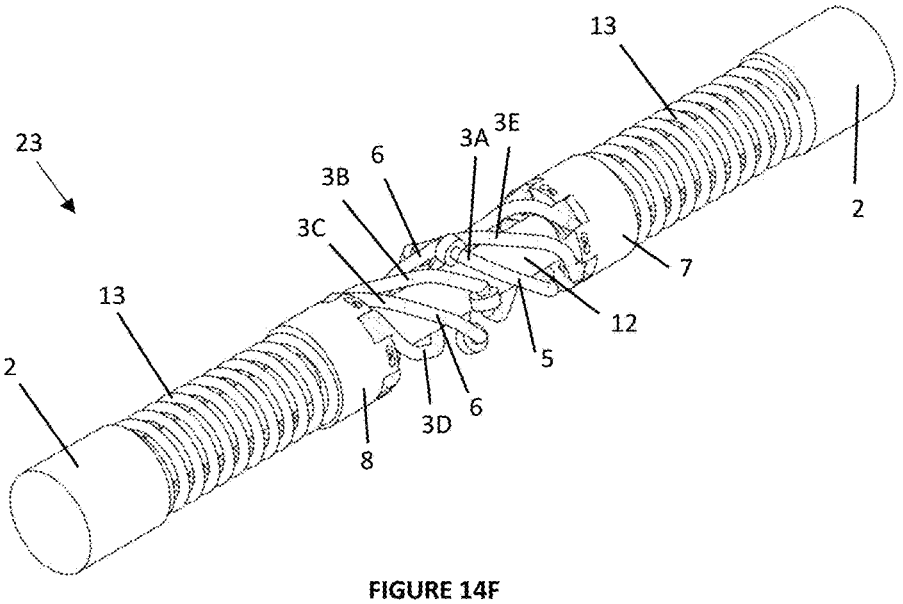

FIGS. 14A to 14F show another embodiment of a centraliser 23 with a 'far-side' pivot configuration similar to the embodiment 20 of FIGS. 10A to 10E described above, however has five arm assemblies 3, referenced as 3A to 3E in FIGS. 14C and 14F. A centraliser must have at least three arm assemblies in order to centralise a tool string. However, preferably the number of arm assemblies is increased to a maximum number of arm assemblies that can be practically fitted around the mandrel 12. The inventors have determined five arm assemblies to be an optimal number of arm assemblies as being a maximum number of arm assemblies that may be practically fitted around the mandrel for the application of centering a tool string in a well bore.

The invention has been described with reference to centering a tool string in a wellbore during a wireline logging operation. However, a centralising device according to the present invention may be used for centering a sensor assembly in a bore in other applications, for example to center a camera in a pipe for inspection purposes.

Although this invention has been described by way of example and with reference to possible embodiments thereof, it is to be understood that modifications or improvements may be made thereto without departing from the spirit or scope of the appended claims.

The invention claimed is:

1. A device for centering a sensor assembly in a bore, the device comprising:

a mandrel;

a first support member and a second support member axially spaced apart along a central longitudinal axis of the device, one or both of the first and second support members is adapted to move axially along the mandrel;

a plurality of arm assemblies spaced circumferentially apart around the central longitudinal axis of the device and connected between the first and second support members, each arm assembly comprising:

a first arm pivotally connected to the first support member by a first pivot joint having a first pivot axis, a second arm pivotally connected to the second support member by a second pivot joint having a second pivot axis, the first and second arms pivotally connected together via a third pivot joint having a third pivot axis, wherein the mandrel comprises a plurality of facets spaced apart around an outer surface of the mandrel and the first and/or second support member has a corresponding plurality of facets spaced apart around an inner surface of the support member, to rotationally key the first and/or second support member to the mandrel, and the third pivot axis is located on a first side of a plane coincident with the central longitudinal axis of the device and the first pivot axis and the second pivot axis are located on an opposite second side of the plane.

2. The device as claimed in claim 1, wherein the facets are arranged so that the mandrel has a polygon shaped outer surface and the first and/or second support member has a corresponding polygon shaped inner surface.

3. The device as claimed in claim 2, wherein the polygon is a regular polygon.

4. The device as claimed in claim 3, wherein the mandrel has a hexagon or octagon shaped outer surface and the first and/or second support member has a corresponding hexagon or octagon shaped inner surface.

5. The device as claimed in claim 1, wherein the plurality of facets is arranged so that each facet is azimuthally aligned with an adjacent one of said first and/or second pivot joint at the first and/or second support member.

6. The device as claimed in claim 1, wherein the plurality of facets is arranged so that each facet extends between adjacent first and/or second pivot joints at the first and/or second support member.

7. The device as claimed in claim 1, wherein the number of facets is equal to the number of arm assemblies or twice the number of arm assemblies.

8. The device as claimed in claim 1, wherein the first pivot axis and the second pivot axis are located radially outside an outside diameter of the mandrel.

9. The device as claimed in claim 1, wherein the first and second pivot axes do not intersect the mandrel.

10. The device as claimed in claim 1, wherein the device comprises one or more spring elements to bias the arm assemblies radially outwards.

11. The device as claimed in claim 1, wherein the device comprises one or more axial spring elements acting on the first support member and/or the second support member to bias the first and second support members axially together and the arm assemblies radially outwards.

12. The device as claimed in claim 1, wherein the first and second pivot joints are azimuthally aligned.

13. The device as claimed in claim 1, wherein the first and second pivot joints are azimuthally misaligned from the third pivot joint by 180 degrees.

14. The device as claimed in claim 1, wherein the plane is a first plane, and the first pivot joint and the second pivot joint are aligned on a second plane coincident with the central longitudinal axis orthogonal to the first plane.

15. The device as claimed in claim 1, wherein the plane is a first plane, and the first pivot joint, the second pivot joint, and the third pivot joint and/or a wheel carried by the arm assembly to contact the bore wall are aligned on a second plane coincident with the central longitudinal axis orthogonal to the first plane.

16. The device as claimed in claim 1, wherein each arm assembly comprises a wheel to contact the bore wall, and wherein the wheel is rotationally coupled to the first arm or second arm on an axis of rotation perpendicular to the central longitudinal axis and offset from the third pivot axis.

17. The device as claimed in claim 1, wherein the plane is a first plane, and the third pivot joint and/or a wheel carried by the arm assembly to contact the bore wall is located on a second plane coincident with the central longitudinal axis and orthogonal to the first plane.

* * * * *